US007759038B2

(12) United States Patent
Yamazaki et al.

(10) Patent No.: US 7,759,038 B2
(45) Date of Patent: Jul. 20, 2010

(54) TONER, DEVELOPMENT UNIT AND IMAGE FORMING APPARATUS USING THE SAME

(75) Inventors: Soichi Yamazaki, Shiojiri (JP); Ken Ikuma, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 459 days.

(21) Appl. No.: 11/955,274

(22) Filed: Dec. 12, 2007

(65) Prior Publication Data

US 2008/0153023 A1 Jun. 26, 2008

(30) Foreign Application Priority Data

Dec. 26, 2006 (JP) ..... 2006-350039
Oct. 25, 2007 (JP) ..... 2007-277177

(51) Int. Cl.
*G03G 9/087* (2006.01)

(52) U.S. Cl. ..... 430/108.11; 430/108.3; 399/286

(58) Field of Classification Search ..... 430/108.11, 430/108.3; 399/286
See application file for complete search history.

(56) References Cited

U.S. PATENT DOCUMENTS 4,910,556 A * 3/1990 Namiki ..... 399/286
2001/0003635 A1* 6/2001 Goto et al. ..... 430/108.11
2004/0137354 A1* 7/2004 Yamazaki et al. ..... 430/109.4

FOREIGN PATENT DOCUMENTS

JP 2001-166527 6/2001
JP 2005-148684 6/2005
JP 2005-345861 12/2005
JP 2006-039446 2/2006
JP 2006-145889 6/2006
JP 2006-163160 6/2006

* cited by examiner

*Primary Examiner*—John L Goodrow
(74) *Attorney, Agent, or Firm*—Hogan Lovells US LLP

(57) ABSTRACT

Disclosed is a toner containing resin mother particles and oil, in which the volume-average particle diameter of the resin mother particles is not less than 2 μm but less than 4 μm, (volume-average particle diameter of the resin mother particles)/(number-average particle diameter of the resin mother particles) is more than 1 but less than 1.1, the oil is silicone oil or fluorine oil, and the content of the silicone oil or fluorine oil is not less than 0.05% by mass but less than 2% by mass relative to the resin mother particles.

11 Claims, 12 Drawing Sheets

TONER, DEVELOPMENT UNIT AND IMAGE FORMING APPARATUS USING THE SAME

CROSS REFERENCES TO RELATED APPLICATION

This application is based upon and claims the benefit of priority from prior Japanese Patent Applications No. 2006-350039, filed Dec. 26, 2006, and prior Japanese Patent Application No. 2007-277177, filed Oct. 25, 2007, the entire contents of which are incorporated herein by reference.

BACKGROUND OF THE INVENTION

1. Field of the Invention

The present invention relates to an electrostatic latent image developing toner used in a copier machine, printer, fax machine, etc. Further, the present invention relates to a development unit and an image forming apparatus using the electrostatic latent image developing toner.

2. Description of the Related Art

In recent years, an image forming apparatus, which is capable of obtaining a high resolution print image, provided with a line head (exposure unit) having a 15 to 40 μm diameter exposure spot which exposes a photoreceptor has been used. The diameter of resin mother particles contained in the toner used in the image forming apparatus is less than 4 μm. A problem encountered when using the toner containing the resin mother particles each having a diameter of less than 4 μm is that the toner is easily scattered and it is difficult to feed the toner to a development roller in a compressed manner. One measure to solve the above problem is to mix the resin mother particles and oil.

In order to prevent toner filming on an electrostatic latent image carrier and a development roller, there has been examined a development unit disclosed in, e.g., Patent Document 1 (JP-A-2001-166527). This development unit performs development by adhering a toner obtained by adding silicon oil or fluorine oil to the resin mother particles to a latent image. The toner contains aggregates of the resin mother particles and therefore development processing in the development unit cannot satisfactorily be performed. When oil is added to the resin mother particles each having a diameter of less than 4 μm, a toner containing aggregates of the resin mother particles may be obtained in some cases. In the case where the toner containing aggregates of the resin mother particles each having a diameter of less than 4 μm is used to perform print processing in an image forming apparatus provided with an exposure unit having a 15 to 40 μm diameter exposure spot which exposes a photoreceptor, a high resolution print image cannot be obtained.

SUMMARY

An advantage of some aspects of the present invention is to provide a toner which contains resin mother particles each having a diameter of less than 4 μm and by which an image forming apparatus provided with a line head having a 15 to 40 μm diameter exposure spot which exposes a photoreceptor can obtain a high resolution print image with a high development efficiency and reduced development unevenness. Another advantage of some aspects of the present invention is to provide a development unit and an image forming apparatus capable of obtaining a high resolution print image by using the toner.

According to a first aspect of the present invention, there is provided a toner containing resin mother particles and oil, wherein the volume-average particle diameter of the resin mother particles is not less than 2 μm but less than 4 μm, (volume-average particle diameter of the resin mother particles)/(number-average particle diameter of the resin mother particles) is more than 1 but less than 1.1, the oil is silicone oil or fluorine oil, and the content of the silicone oil or fluorine oil is not less than 0.05% by mass but less than 2% by mass relative to the resin mother particles.

Preferably, in the present invention, the bulk density of the resin mother particles is not less than 0.25 g/cm$^3$ but less than 0.35/cm$^3$.

Preferably, in the present invention, the oil is dimethyl silicone oil having a kinetic viscosity of 50 to 300 mm$^2$/s at 25° C.

Preferably, in the present invention, a binder resin of the resin mother particles is a polyester resin.

Preferably, in the present invention, an acid value of the polyester resin is 3 to 30 KOHmg/g.

Preferably, in the present invention, the binder resin of the resin mother particles is a mixture of the cross-linked polyester resin and straight-chain polyester resin, the mixing ratio thereof being 5/95 to 60/40.

Preferably, in the present invention, the cross-linked polyester resin has a glass transition temperature of 40 to 85° C. and a softening point of 150 to 220° C.

Preferably, in the present invention, the straight-chain polyester resin has a glass transition temperature of 35 to 70° C. and a softening point of 90 to 130° C.

Preferably, in the present invention, silica fine particles or titania fine particles are externally added to the toner.

According to a second aspect of the present invention, there is provided a development unit which performs non-contact jumping development using a toner, the toner containing resin mother particles and oil, wherein the volume-average particle diameter of the resin mother particles is not less than 2 μm but less than 4 μm, (volume-average particle diameter of the resin mother particles)/(number-average particle diameter of the resin mother particles) is more than 1 but less than 1.1, the oil is silicone oil or fluorine oil, and the content of the silicone oil or fluorine oil is not less than 0.05% by mass but less than 2% by mass relative to the resin mother particles, the development unit including: a photoreceptor; a development roller; and a gap adjustment member provided on both sides of the development roller, the development roller being provided such that the toner feeding surface thereof is opposed to the photoreceptor with a predetermined development gap and feeding the toner to the photoreceptor, the gap adjustment member being a spacer which is brought into contact with the photoreceptor to set a development gap, and the spacer being made of a material having hygroscopicity higher than that of the development roller and fixed to the development roller through a layer having elasticity.

According to a third aspect of the present invention, there is provided an image forming apparatus wherein a toner is used to perform an image formation process, the toner containing resin mother particles and oil, wherein the volume-average particle diameter of the resin mother particles is not less than 2 μm but less than 4 μm, (volume-average particle diameter of the resin mother particles)/(number-average particle diameter of the resin mother particles) is more than 1 but less than 1.1, the oil is silicone oil or fluorine oil, and the content of the silicone oil or fluorine oil is not less than 0.05% by weight but less than 2% by weight relative to the resin mother particles, the image forming apparatus including a development unit which performs non-contact jumping development using the toner and a line head, the development unit including: a photoreceptor; a development roller; and a gap adjustment member provided on both sides of the development roller, the development roller being provided such that the toner feeding surface thereof is opposed to the photoreceptor with a predetermined development gap and feeding the toner to the photoreceptor, the gap adjustment member being a spacer which is brought into contact with the photoreceptor to set a development gap, and the spacer being made of a material having hygroscopicity higher than that of the development roller and fixed to the development roller through a layer having elasticity, the line head focusing a light beam onto a surface to be scanned fed in the sub-scanning direction substantially perpendicular to the main scanning direction to form a spot and including: a plurality of light-emitting device groups each having a plurality of light-emitting devices; and a plurality of focusing lenses disposed in one-to-one correspondence with the light-emitting device groups and each focus a light beam emitted from each of the light-emitting devices belonging to the corresponding light emitting device group, wherein, in each light emitting device group, the light-emitting devices are two-dimensionally arranged such that a plurality of light-emitting device group lines including two or more light-emitting devices arranged in the main scanning direction are arranged in the sub-scanning direction in such a manner that a distance Gx between the upstreammost light-emitting device and downstreammost light-emitting device in the main scanning direction becomes larger than a distance Gy between the upstreammost light-emitting device and downstreammost light-emitting device in the sub-scanning direction, and the light-emitting device groups are two-dimensionally arranged such that a plurality of light-emitting device group lines including two or more light-emitting device groups arranged in the main scanning direction at a main scanning group pitch Px are arranged in the sub-scanning direction at a sub-scanning group pitch Py in such a manner that the main scanning group pitch Px becomes larger than sub-scanning group pitch Py.

DETAILED DESCRIPTION OF THE PREFERRED EMBODIMENTS

Figure 1:
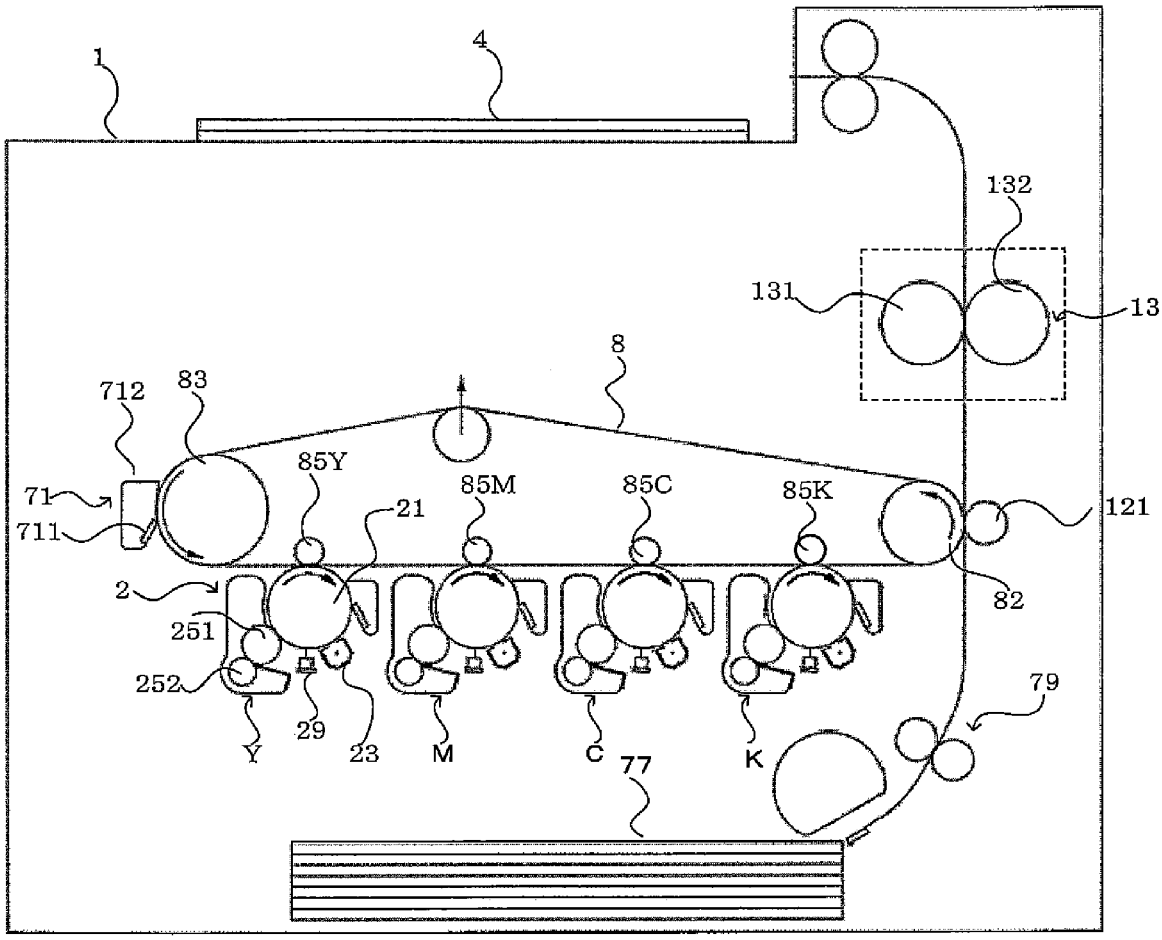
FIG. 1 is a view showing an embodiment of an image forming apparatus according to the present invention.

A method of producing resin mother particles contained in a toner according to the present invention will be described in detail below. The production method includes the following four processes.

First Step: Colored Resin Solution Preparation Step

The first step is a step in which a binder resin, wax and colorant are dissolved or dispersed into an organic solvent to obtain a colored resin solution.

Second Process: Emulsification Step

The second step is a step in which a basic compound and water are sequentially added to the colored resin solution and thereby the colored resin solution is emulsified into an aqueous medium.

Third Step: Coalescence Step

The third step is a step in which operation of adding an electrolyte solution to the prepared emulsified suspension so as to allow dispersoids in the emulsified suspension to coalesce with each other to thereby generate colored resin fine particles is carried out at least one time.

Fourth Step: Separation and Drying Step

The fourth step is a step in which the organic solvent is removed under reduced pressure and the resin mother particles are separated from the aqueous medium and, then, washed and dried.

First, the colored resin solution preparation step (first step) will be described in detail. In this colored resin solution preparation step, a binder resin, wax, and colorant are poured into an organic solvent to be dissolved or dispersed.

The binder resin, wax, and colorant are preferably dissolved or dispersed in the organic solvent by means of a high-speed stirring machine. At this time, a master kneaded chip in which colorant is preliminarily dispersed can be used. Also, there can be used a master kneaded chip in which wax is preliminarily dispersed or a wax master solution in which a medium is used to fine-disperse wax particles each having a diameter equal to or less than that of toner particles by a wet dispersion method.

In the colored resin solution preparation step, a high-speed stirring machine such as "DESPER" (manufactured by Asada Tekko Co., Ltd.), or "T.K. Homomixer" (manufactured by PRIMIX Corporation) is used. The blade peripheral speed at this time is preferably 4 to 30 m/s and, more preferably, 8 to 25 m/s. A use of the high-speed stirring machine allows effective dissolution of the binder resin into the organic solvent, as well as achievement of fine homogeneous dispersion of the colorant into the binder resin solution.

When the blade peripheral speed is lower than 4 m/s, the fine dispersion of the colorant into the binder resin solution becomes insufficient. On the other hand, when the blade peripheral speed is higher than 30 m/s, heat generation by shear is increased, making it difficult to achieve uniform stirring, coupled with volatilization of the solvent. The temperature at the time of dissolution or dispersion is preferably 20 to 60° C. and, more preferably, 30 to 50° C.

The solubility of the organic solvent with respect to water at a temperature of 25° C. is preferably 0.1 to 30% by mass and, more preferably, 0.1 to 25% by mass. The boiling point of the organic solvent at normal pressure is lower than that of water. Specific examples of the organic solvents satisfying these conditions include ketone compounds such as methyl ethyl ketone and methyl isopropyl ketone; and ester compounds such as ethyl acetate and isopropyl acetate. Although a mixture of two or more organic solvents can be used, it is preferable to use a single organic solvent in terms of collection efficiency. An organic solvent having a low boiling point which can dissolve the binder resin and can easily be removed in the subsequent step is preferably used.

Emulsifying agent can be poured into the organic solvent together with the binder resin, colorant, and wax.

In order to allow the emulsifying agent to function in the coalescence step, dispersion stability needs to be maintained in the presence of electrolyte to be added later. Specific examples of the emulsifying agent having such characteristics include polyoxyethylene nonylphenyl ether, polyoxyethylene octylphenyl ether, polyoxyethylene dodecylphenyl ether, polyoxyethylene alkyl ether, polyoxyethylene fatty acid ester, sorbitan fatty acid ester, polyoxyethylene sorbitan fatty acid ester, nonionic emulsifying agent such as Pluronic series, alkylsulfuric acid ester salt type or alkylsulfonate salt type anionic emulsifying agent, quaternary ammonium salt type cationic emulsifying agent, alkylbenzene sulfonic acid salt type emulsifying agent, and linear alkylbenzenesulfonate type emulsifying agent.

The above-mentioned emulsifying agent can be used singularly or in combination of two or more. That is, in the production method of the resin mother particles contained in the toner according to the present invention, electrolyte is added in the presence of the emulsifying agent to prevent inhomogeneous coalescence, thereby obtaining favorable particle size distribution.

The amount of the emulsifying agent used is preferably 0.1 to 3.0% by mass based on the total solid content, more preferably, 0.3 to 2.0% by mass and, even more preferably, 0.3 to 1.5% by mass. When the amount of the emulsifying agent used is less than 0.1% by mass based on the total solid content, the intended effect of preventing occurrence of coarse particles cannot be obtained. On the other hand, when the amount of the emulsifying agent used exceeds 3.0% by mass based on the total solid content, coalescence of dispersoids in the emulsified suspension does not sufficiently proceed even when the amount of electrolyte is increased. Accordingly, particles each having a predetermined particle diameter cannot be obtained and thus fine particles remain, thereby resulting in yield reduction.

Subsequently, in the emulsification step (second step), a basic compound and water are sequentially added to the colored resin solution and thereby the colored resin solution is emulsified into an aqueous medium. Preferably, the water is gradually added to the colored resin solution in which a carboxyl group in the binder resin is neutralized by the base compound. The hydrophilic property of the binder resin is enhanced by the neutralization of the carboxyl group, resulting in an enhancement of hydrophilic property between the water and binder resin.

The added water is hydrated with the carboxyl group part in the binder resin, and the binder resin is dissolved or fine-dispersed, coupled with stirring effect. On the other hand, the presence of the binder resin in the aqueous medium increases the acid-base interaction with the result that the viscosity of a system including the colored resin solution is increased with the addition of the water. A point at which the viscosity is decreased when a constant amount of water is added is referred to as "phase inversion point". The viscosity is increased to reach the maximum value immediately before the phase inversion point. The increase in the viscosity is associated with the additive amount of the base compound. That is, the larger the additive amount of the base compound, the larger the viscosity increase rate.

On the other hand, the amount of the base compound influences not only the emulsification step (second step) but also homogeneity and generation speed of the colored resin particles in the coalescence step (third step) to be described later. The additive amount of the base compound is preferably 1 to 3 equivalent weight per equivalent weight of the carboxyl group in the binder resin and, more preferably, 1 to 2 equivalent weight. An excessive addition of the base compound by an amount larger than the amount required for neutralizing all the carboxyl groups in the binder resin prevents generation of deformed particles in the coalescence step and narrows the distribution of the size of the resin mother particles.

The ratio of the organic compound relative to the total amount of the organic compound and water after the emulsification step is preferably 20 to 35% by mass and, more preferably, 20 to 30% by mass. As described above, the additive amount of the water up to the phase inversion point is decreased as the amount of the organic solvent in the colored resin solution preparation step is small; while increased as the amount of the organic solvent is large. Since the viscosity of the emulsified suspension is high at the phase inversion point and therefore the colored resin solution may not completely be fine-dispersed in the aqueous medium, it is preferable to add further water. The additive amount of the water is preferably 50 to 80% by mass based on the total of the amount of the water added up to the phase inversion point and amount of the water used up to the phase inversion point.

Specific examples of the base compound for neutralization include: an inorganic base such as sodium hydroxide, potassium hydroxide, and ammonia; and an organic base such as diethylamine, triethylamine, isopropylamine. Preferably used is an inorganic base such as sodium hydroxide, potassium hydroxide, and ammonia.

In the emulsified suspension produced by the above method, the colored resin solution exists in an emulsified state in the aqueous medium. The emulsified state differs depending on the type of the organic solvent used, use amount thereof, acid value of the binder resin, use amount of the base compound, stirring condition, and the like. Preferably, the colored resin solution exists in an emulsified state as oil droplets in which dispersoid, such as resin oil droplets, wax dispersoid, colorant dispersoid, having a particle diameter of less than 1 μm. When such a condition can be obtained, stability of the emulsified suspension, coalescence stability in the subsequent steps, particle size distribution of the colored resin fine particles, and the like become satisfactory.

Next, the coalescence step (third step) will be described. The addition of the electrolyte salts out the colored resin fine particles or makes the same unstable, allowing coalescence of the colored resin fine particles to proceed, whereby coalesced particles are produced.

Specific examples of the electrolyte used here include water-soluble salts such as sodium sulfate, ammonium sulfate, potassium sulfate, magnesium sulfate, sodium phosphate, sodium dihydrogenphosphate, sodium chloride, potassium chloride, ammonium chloride, calcium chloride, and sodium acetate. The electrolyte is composed of a single water-soluble salt or a mixture of two or more water-soluble salts. Preferably used is sulfate salt having a monovalent cation, such as sodium sulfate and ammonium sulfate for homogeneous coalescence.

The obtained colored resin fine particles are swollen by the solvent and the hydration state of the particles is made unstable due to the addition of the electrolyte. Thus, the coalescence is preferably carried out under a low shear condition in which dissociation of the colored resin fine particles does not occur but only the coalescence proceeds.

The stirring condition at the coalescence time is important to achieve homogeneous coalescence. Specific examples of stirring blades include an anchor blade, turbine blade, Pfaudler blade, full zone blade, Max Blend blade (registered trademark of Sumitomo Heavy Industries, Ltd.), and half-moon blade. Preferably used is a large-sized blade, such as a Max Blend blade or full zone blade, which exhibits uniform mixing performance even with a low rotation speed.

The peripheral speed of the stirring blade for generating a homogeneous coalesced body is preferably 0.2 to 10 m/s, more preferably 0.2 to 8 m/s, and even more preferably, 0.2 to 6 m/s. When the peripheral speed of the stirring blade is higher than 10 m/s, fine particles remain. On the other hand, when the peripheral speed is lower than 0.2 m/s, stirring becomes nonuniform, causing coarse particles to be generated. With the above condition, the coalescence proceeds only by collision between the colored resin fine particles, preventing the colored resin fine particles from being dissociated and dispersed. In particular, in the coalescence step, fine particles are less generated and particle size distribution of the colored resin fine particles is narrowed.

That is, stirring is preferably carried out by means of a high-speed stirring machine in the colored resin solution preparation step and emulsification step and is preferably carried out by means of a large-sized blade, such as a Max Blend blade, which exhibits uniform mixing performance even with a low rotation speed in the coalescence step. Accordingly, it is preferable that the emulsified suspension obtained in the emulsification step be transferred to another vessel provided with a large-sized blade followed by the coalescence step.

The amount of the electrolyte used is preferably 0.5 to 15% by mass based on the total solid content, more preferably 1 to 12% by mass and, even more preferably, 1 to 6% by mass. When the amount of the electrolyte is smaller than 0.5% by mass, the coalescence does not sufficiently proceed. When the amount of the electrolyte is larger than 15% by mass, a large amount of stationary water used in the subsequent step becomes necessary, and much time is required for washing and drying, resulting in a reduction in productivity.

The concentration of the electrolyte solution is preferably 1 to 15% by mass and, more preferably, 3 to 10% by mass. When the concentration of the electrolyte solution is lower than 1% by mass, effect of the electrolyte is not sufficiently exerted and therefore a large amount of electrolyte becomes necessary for salting out and coalescence, which may prevent generation of the colored resin fine particles. On the other hand, when the concentration is higher than 15% by mass, unevenness easily occurs in the system and therefore aggregates occur when the colored resin fine particles are generated at the initial-stage of the coalescence, with the result that coarse particles are easily generated.

In the coalescence step, the electrolyte is quickly mixed into the system in a homogeneous manner when the electrolyte solution is added. Therefore, the stirring speed is preferably increased. The temperature at the coalescence time is preferably 10 to 50° C., more preferably, 20 to 40° C. and, even more preferably, 20 to 35° C. When the temperature is lower than 10° C., the coalescence does not sufficiently proceed. When the temperature is higher than 50° C., the coalescence speed is increased to promote generation of aggregates and coarse particles. The resin mother particles contained in the toner according to the present invention can be produced at a coalescence temperature of 20 to 40° C.

In the coalescence step, the colored resin fine particles which have been swollen by the organic solvent collide with each other to be fused together, whereby the particles grow larger.

Since a certain growth rate is maintained under a certain condition, the particle growth can be represented by a particle growth curve in which time and particle diameter are plotted. As a result, arrival time to the target particle diameter can be estimated from the curve. The coalescence is preferably stopped by addition of water.

Solvent removal is speedily carried out under a low temperature condition. Thus, the solvent removal is preferably carried out under reduced pressure. Preferably, antifoam is added for the solvent removal. Preferably used is silicone emulsion antifoam. Specific examples of the silicone antifoam include BY22-517, SH5503, SM5572F, and BY28-503 (produced by Dow Corning Toray Co., Ltd.), KM75, KM89, KM98, KS604, and KS538 (produced by Shinetsu Chemical Co., Ltd.). Among them, BY22-517 which has less influence on the physical properties and has high antifoam performance is preferably used. The additive amount of the antifoam is preferably 30 to 100 ppm relative to the total solid content.

In the separation/drying step (fourth step), the colored resin fine particles are separated from the aqueous medium and, then, washed and dried. The separation of the colored resin fine particles from the aqueous medium is carried out by means of a separation means such as a centrifugal separator, filter press, or belt filer. Subsequently, resin mother particles are obtained by drying of the particles. Specific examples of dryers include a mixer vacuum dryer such as Ribocone dryer (manufactured by Okawara Corporation), and Nauta mixer (manufactured by Hosokawa Micron Corporation); and a fluidized-bed dryer such as fluidized bed dryer (manufactured by Okawara Corporation), and vibro-fluidized bed (manufactured by Chuo Kakouki).

The resin mother particles produced by the above production method includes additives such as the colorant and wax in the binder resin. When the resin mother particles are observed using a transmission electron microscope, it can be confirmed that the additives such as the colorant and wax are included in the particle and dispersed in substantially a homogeneous manner.

It is conceivable that the toner according to the present invention is composed of secondary particles in which the resin mother particles are flocculated by a liquid bridge force of silicone oil or fluorine oil. The secondary particles do not exhibit scattering properties and feeding difficulty to a development roller, which are disadvantages of the resin mother particles each having a diameter of less than 4 μm. Further, the secondary particles are cracked during their reciprocating motion between a development roller and photoreceptor constituting a non-contact jumping development unit (to be described later) which uses an alternating bias. Thus, in an image forming process using the toner according to the present invention, development is carried out by means of the resin mother particles each having a diameter of less than 4 μm, whereby a high resolution print image can be obtained.

The volume-average particle diameter (Dv)/number-average particle diameter (Dn) of the resin mother particles contained in the toner according to the present invention is more than 1 but less than 1.1. When oil is added to the resin mother particles having a Dv/Dn equal to or less than 1 or equal to or more than 1.1, small-diameter toner particles interpose between large-diameter toner particles, causing the resin mother particles to be strongly aggregated by a liquid bridge force, with the result that the obtained secondary particles are not cracked during their reciprocating motion between a development roller and photoreceptor constituting a non-contact jumping development unit.

The volume-average particle diameter of the resin mother particles contained in the toner according to the present invention is not less than 2 μm but less than 4 μm. In an image forming process using a toner obtained from the resin mother particles each having a diameter of less than 4 μm, there are advantages not only that a high resolution and high gradation print image can be obtained, but that the thickness of the toner layer forming a print image is small and thereby the amount of heat required for fixing an image and toner consumption are small. The resin mother particles each having a diameter of less than 2 μm each contain not less than 20% by mass of colorant and, therefore, fixability is lowered.

The bulk density of the resin mother particles each having a volume-average particle diameter of not less than 2 μm but less than 4 μm is within 0.25 g/cm$^3$. Since the toner according to the present invention is a mixture of the resin mother particles each having a volume-average particle diameter of not less than 2 μm but less than 4 μm and silicone oil or fluorine oil, the bulk density of the toner according to the present invention is not less than 0.25 g/cm$^3$. The upper limit of the bulk density of the toner according to the present invention is preferably less than 0.35 g/cm$^3$. The toner having a bulk density of not less than 0.35 g/cm$^3$ has secondary particles in which the resin mother particles are strongly aggregated. The second particles are not cracked during their reciprocating motion between a development roller and photoreceptor constituting a non-contact jumping development unit. One method of controlling the bulk density of the toner according to the present invention is to control mixing time of the resin mother particles and silicone oil or fluorine oil. When the mixing time is too long, the bulk density of the toner exceeds 0.35 g/cm$^3$.

Specific examples of silicone oil contained in the toner according to the present invention include dimethyl silicone oil, hydrogen silicone oil, phenyl silicone oil, amino silicone oil, epoxy silicone oil, carboxy silicone oil, polyether silicone oil, hydrophilic silicone oil, methacryl silicone oil, mercapto silicone oil, one side reactive silicone oil, higher alkoxy silicone oil, and alkyl silicone oil.

Among them, dimethyl silicone oil is preferably used. The lubricating property, chemical stability and thermal stability of the dimethyl silicone oil are excellent. Further, the dimethyl silicone oil is not harmful to human bodies. Thus, it can be said that the dimethyl silicone oil is a toner additive excellent in stability and safety. The kinetic viscosity of the dimethyl silicone oil at a temperature of 25° C. is preferably 50 to 300 mm$^2$/s. The dimethyl silicone oil having a kinetic viscosity of less than 50 mm$^2$/s is easily volatized and thereby can change the physical properties of the toner. The dimethyl silicone oil heated in an image forming apparatus and carried on the resin mother particles each having a large surface area is, in particular, easily volatized. The dimethyl silicone oil having a kinetic viscosity exceeding 300 mm$^2$/s can form toner aggregates. The aggregated toner leads to a defective development, which may cause unevenness.

Specific examples of the fluorine oil contained in the toner according to the present invention include perfluoro polyether and polytrifluorochloroethylene. The additive amount of the silicone oil or fluorine oil is not less than 0.05 but less than 2% by mass relative to the resin mother particles. When the additive amount of the silicone oil or fluorine oil is less than 0.05% by weight relative to the resin mother particles, the resin mother particles are not flocculated and, therefore, second particles in which the resin mother particles are aggregated together cannot be obtained. On the other hand, when the additive amount of the silicone oil or fluorine oil is not less than 2% by mass relative to the resin mother particles, the resin mother particles are strongly aggregated, with the result that the obtained secondary particles are not cracked during their reciprocating motion between a development roller and photoreceptor constituting a non-contact jumping development unit.

The binder resin of the resin mother particles of the toner according to the present invention is not especially limited. The resin binder is preferably a polyester resin having an acid value of 3 to 30 KOHmg/g and, more preferably a polyester resin having an acid value of 5 to 20 KOHmg/g. When the acid value of the polyester resin is less than 3, it is impossible to produce the resin mother particles. On the other hand, when the acid value of the polyester resin is larger than 30, the charge amount in an environment where the toner is used becomes unstable. The polyester resin having an acid value of 3 to 30 KOHmg/g becomes anion when the carboxyl group is neutralized by the base compound. As a result, the hydrophilic property of the resin is enhanced and, thereby, the resin is stably dissolved or dispersed.

The polyester resin is a cross-linked polyester resin and/or a straight-chain polyester resin and is obtained by a reaction of compounds selected from the following materials.

The cross-linked polyester resin is preferably produced by a reaction among divalent basic acid or derivatives thereof, divalent alcohol, and a polyvalent compound serving as a cross-linking agent. The cross-linked polyester resin is more preferably produced by a reaction among divalent basic acid or derivatives thereof, divalent aliphatic polyvalent alcohol, and a polyvalent epoxy compound serving as a cross-linking agent.

The straight-chain polyester resin is produced by a reaction between divalent basic acid and divalent alcohol.

Specific examples of the divalent basic acid used in production of the polyester resin include phthalic anhydride, terephthalic acid, isophthalic acid, orthophthalic acid, adipic acid, maleic acid, maleic acid anhydride, fumaric acid, itaconic acid, citraconic acid, hexahydrophthalic anhydride, tetrahydro phthalic anhydride, cyclohexanedicarboxylic acid, succinic acid, malonic acid, glutaric acid, azelaic acid, sebacic acid, and derivatives of the abovementioned compounds.

Specific examples of the divalent aliphatic alcohol include 1,4-cyclohexanedimethanol, ethylene glycol, diethylene glycol, propylene glycol, triethylene glycol, dipropylene glycol, tripropylene glycol, neopentyl glycol, butanediol, pentanediol, hexanediol, polyethylene glycol, polypropylene glycol, ethylene oxide-propylene oxide random copolymer diol, ethyleneoxide-propylene oxide block copolymer diol, ethylene oxide-tetrahydrofran copolymer diol, and polycaprolactonediol.

The polyester resin produced using the aliphatic alcohol has a good compatibility with waxes and, accordingly the toner containing the resin mother particles in which the polyester resin serves as the binder resin has an excellent anti-offset properties. The fixability at a low temperature is improved by the flexibility of the polyester main chain. In the production of the cross-linked polyester resin, the polyvalent epoxy compound is used as a cross-linking agent. Specific examples of the polyvalent epoxy compound include bisphenol A epoxy resin, bisphenol F epoxy resin, bisphenol S epoxy resin, ethylene glycol diglycidyl ether, hydroquinone diglycidyl ether, N,N-diglycidyl aniline glycerin triglycidyl ester, trimethylolpropane triglycidyl ether, trimethylolethane triglycidyl ether, pentaerythritol tetraglycidyl ether, 1,1,2,2-tetrakis(p-hydroxyphenyl)-ethane tetraglycidyl ether, cresol novolac epoxy resin, phenol novolac epoxy resin, polymer of vinyl compound having an epoxy group, epoxylated resorcinol-acetone condensate, partially epoxidized polybutadiene, semi-dry or dry fatty acid ester epoxy compound. Preferably used among them are bisphenol A epoxy resin, bisphenol F epoxy resin, bisphenol S epoxy resin, cresol novolac epoxy resin, phenol novolac epoxy resin, glycerin triglycidyl ether, trimethyrol propane triglycidyl ether, trimethyrol ethane triglycidyl ether, pentaerythritol tetraglycidyl ether.

Specific examples of the bisphenol A epoxy resin include Epichlon 850, Epichlon 1050, Epichlon 2055, and epichlon 3050 (manufactured by Dainippon Ink and Chemicals Inc.). Specific examples of the bisphenol F epoxy resin include Epichlon 8300 and Epichlon 520 (manufactured by Dainippon Ink and Chemicals Co., Ltd.). Specific examples of the orthocresol novolac epoxy resin include, Epichlon N-660, N-665, N-667, N-670, N-673, N-680, N-690, and N-695 (manufactured by Dainippon Ink and Chemicals Inc.). Specific examples of the phenol novolac epoxy resin include Epichlon N-740, N-770, N-775, and N-865 (manufactured by Dainippon Ink and Chemicals Co., Ltd.). Specific examples of the polymer of vinyl compound having an epoxy group include homopolymer of glycidyl (meth)acrylate, copolymer of glycidyl(meth)acrylate-acrylic, and copolymer of glycidyl (meth)acrylate-styrene.

It is possible to combine two or more of the abovementioned polyvalent epoxy compounds. Further, the mono-epoxy compound mentioned below can be used together with the polyvalent epoxy compounds as a resin-modifying agent: phenyl glycidyl ether, alkylphenyl glycidyl ether, alkyl glycidyl ether, alkyl glycidyl ester, glycidyl ether of alkylphenol alkylene oxide adduct, α-olefin oxide, mono-epoxy aliphatic acid alkyl ester.

The fixability and anti-offset properties at high temperature of the toner according to the present invention are enhanced by the simultaneous use of the above mono-epoxy compounds. Particularly preferably used among them is alkyl glycidyl ester. A specific example thereof is Cardura E (neodecanoic acid glycidyl ester made by Shell Chemicals Japan Ltd.).

The above raw material components undergo dehydration-condensation reaction or ester exchange reaction under the existence of catalyst, whereby a cross-linked polyester resin and/or a straight-chain polyester resin is obtained. Although not especially limited, the reaction temperature and reaction time are generally 150 to 300° C. and 2 to 24 hours.

Specific examples of a catalyst used in the above reaction are tetrabutyl titanate, zinc oxide, stannous oxide, dibutyltin oxide, dibutyltin dilaurate, and p-toluenesulfonic acid.

In the case where a mixture of the cross-linked polyester resin and straight-chain polyester resin is used, the mixing ratio thereof is not especially limited. The mixing ratio (weight of cross-linked polyester resin)/(weight of straight-chain polyester resin) is preferably 5/95 to 60/40, more preferably, 10/90 to 40/60 and, even more preferably, 20/80 to 40/60. When the ratio of the cross-linked polyester resin is lower than 5% by mass, the anti-hot-offset properties of the toner according to the present invention, toner particles emulsification speed, and dispersibility of additives such as wax or colorant into the resin mother particles are deteriorated. When the ratio of the cross-linked polyester resin is higher than 60% by mass, the melt viscosity (T1/2 temperature) of the resin mother particles is increased with the result that the low temperature fixability of the resin mother particles is deteriorated.

The glass transition temperature (Tg) of the cross-linked polyester resin is not especially limited. The Tg of the cross-linked polyester resin is preferably 40 to 85° C. and, more preferably, 60 to 80° C. When the Tg of the cross-linked polyester resin is lower than 40° C., a blocking phenomenon (thermal aggregation) is likely to occur when the resin mother particles are stored, transported, or exposed to a high temperatures in a developing unit. When the Tg of the cross-linked polyester resin is higher than 85° C., the low temperature fixability of the resin mother particles is deteriorated.

The glass transition temperature (Tg) of the straight-chain polyester resin is not especially limited. The Tg of the straight-chain polyester resin is preferably 35 to 70° C. and, more preferably, 50 to 65° C. When the Tg of the straight-chain polyester resin is lower than 35° C., a blocking phenomenon (thermal aggregation) is likely to occur when the resin mother particles are stored, transported, or exposed to a high temperatures in a developing unit. When the Tg of the straight-chain polyester resin is higher than 70° C., the low temperature fixability of the resin mother particles is deteriorated.

The softening point of the cross-linked polyester resin is not particularly limited. The softening point of the cross-linked polyester resin is preferably not less than 150° C., more preferably, 150 to 220° C. and, even more preferably, 170 to 190° C. When the softening point of the cross-linked polyester resin is less than 150° C., the resin mother particles are likely to aggregated, which may cause a trouble when the resin mother particles are stored or during printing operation. When the softening point of the cross-linked polyester resin exceeds 220° C., the fixability of the resin mother particles is deteriorated.

The softening point of the straight-chain polyester resin is not particularly limited. The softening point of the straight-chain polyester resin is preferably not less than 90° C., more preferably, 90 to 130° C. and, even more preferably, 90 to 110° C. When the softening point of the straight-chain polyester resin is less than 90° C., the glass transition temperature of the straight-chain polyester resin is decreased, so that the resin mother particles are likely to aggregated, which may cause a trouble when the resin mother particles are stored or during printing operation. When the softening point of the straight-chain polyester resin exceeds 130° C., the fixability of the resin mother particles is deteriorated.

The softening point of the polyester resin is defined by the temperature T1/2 as measured by a constant load extrusion type capillary rheometer, (Flow Tester CFT-500 manufactured by Shimadzu Corporation). The measurement by the flow tester is conducted under the conditions of a piston cross-sectional area of 1 $cm^2$, a cylinder pressure of 0.98 MPa, a die length of 1 mm, a die pore diameter of 1 mm, a measuring initiation temperature of 50° C., a heating rate of 6° C./min, and a sample weight of 1.5 g.

The glass transition temperature (Tg) of the polyester resin is measured by using a DSC (DSC-60A manufactured by Shimadzu Corporation). A 20 mg sample is placed in an aluminum crimp cell, heated at a heating rate of 10° C./min to 180° C., then cooled at a cooling rate of 10° C./min to a room temperature, and heated once again at a heating rate of 10° C./min to 180° C., and the second run value is set as the Tg.

A charge control agent can be mixed with the colored resin solution. Fine particles such as silica or titania, or fine particles obtained by hydrophobizing the silica or titania is added as an external additive agent, whereby the flowability and electrostatic properties can be adjusted.

A development unit and image forming apparatus according to the present invention will next be described. FIG. 1 shows an embodiment of an image forming apparatus according to the present invention. The image forming apparatus of FIG. 1 can selectively execute a color mode in which four color toners of black (K), cyan (C), magenta (M), and yellow (Y) are superimposed to form a color image and a monochrome mode in which only a black (K) toner is used to form a monochrome image. FIG. 1 shows a state in which the color mode is selected.

An image forming unit 2 has four image forming stations of Y (yellow), M (magenta), C (cyan), and K (black) which form a plurality of different colors. Photosensitive drums 21 on the surfaces of which toner images of respective colors are formed are provided in the respective image forming stations Y, M, C, and K. Each of the photosensitive drums 21 is connected to a dedicated drive motor and is rotated in the direction of an arrow in FIG. 1 at a predetermined speed, whereby the surface of each photosensitive drum 21 is fed in the sub-scanning direction. A charging section 23, a line head 29, a development section 25, and a photoreceptor cleaner 27 are provided around the photosensitive drum 21 in its rotation direction. At the time of operation in the color mode, toner images formed by all the image forming stations Y, M, C, and K are superimposed onto a transfer belt 8 to form a color image. At the time of operation in the monochrome mode, a monochrome image is formed by a toner image formed only by the image forming station K. The respective image forming stations of the image forming unit 2 have the same configuration in FIG. 1, so that reference numerals are given only to some image forming stations, and reference numerals for other image forming stations are omitted.

The charging section 23 has a charging roller having a surface formed of an elastic rubber. The charging roller 23 is brought into contact with the surface of the photosensitive drum 21 at a charging position and thereby is rotated according to the rotation of the photosensitive drum 21 in the opposite direction thereof at a predetermined circumferential speed. This charging roller is connected to a charging bias generator (not shown) and receives a charging bias from the charging bias generator to thereby charge the surface of the photosensitive drum 21 at the charging position at which the charging section 23 and photosensitive drum 21 are brought into contact with each other.

The line head 29 has a plurality of light-emitting devices arranged in the axial direction (perpendicular direction relative to the paper sheet face of FIG. 1) of the photosensitive drum 21 and spaced apart from the photosensitive drum 21. Lights are emitted from the light emitting devices to the surface of the photosensitive drum 21 whose surface has been charged by the charging section 23, whereby a latent image is formed on the surface of the photosensitive drum 21.

The development section 25 has a development roller 251 for feeding a toner to the photosensitive drum 21 and a supply roller 252 for supplying a toner to the development roller 251. When an alternate bias is applied from a developing bias generator (not shown) electrically connected to the developing roller 251 to the development roller 251, an electrostatic latent image formed by the line head 29 is visualized by a non-contact jumping development method in which a charged toner on the development roller 251 is jumped to the photosensitive drum 21 at a development position at which the development roller 251 and photosensitive drum 21 come close to each other. The non-contact jumping development method is described in JP-A-2006-163160.

Figure 2:
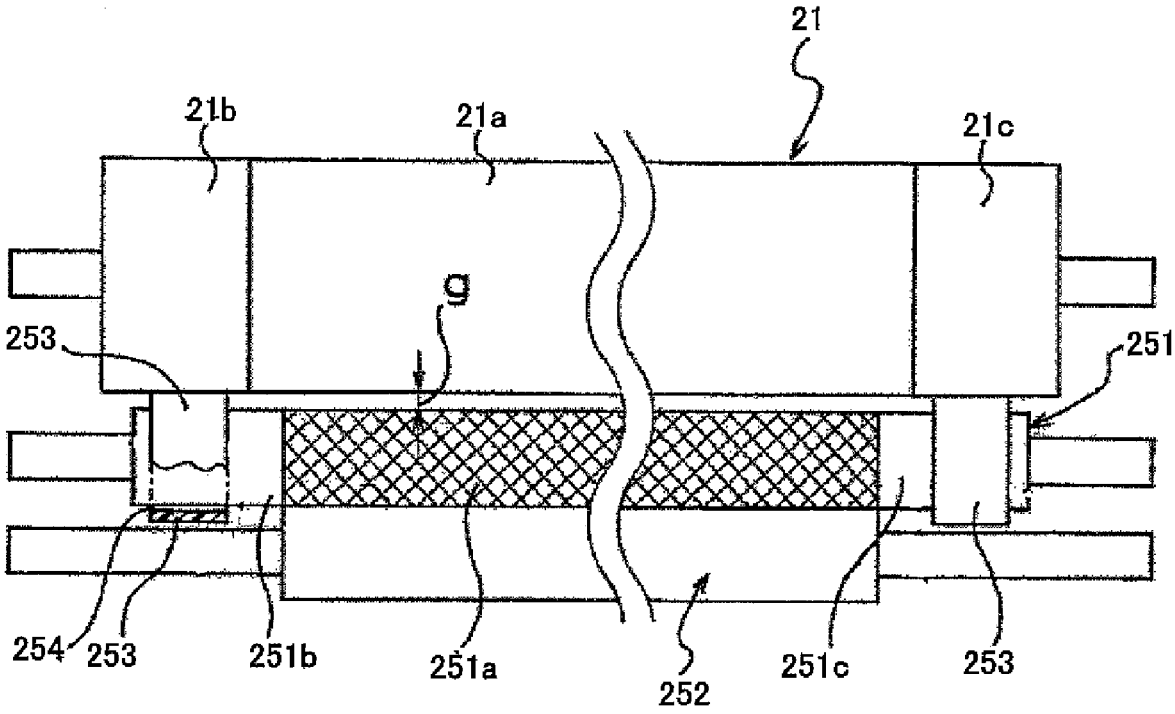
FIG. 2 is a view schematically showing a development gap.

FIG. 2 is a view schematically showing a development gap provided between the photosensitive drum 21 and development roller 251. An image carrying surface 21*a* is formed in the center of the photosensitive drum 21. Image non-carrying surfaces 21*b* and 21*c* are formed on both sides of the photosensitive drum 21. Toner carrying surface 251*a* is formed in the center of the development roller 251. Toner non-feeding surfaces 251*b* and 251*c* are formed on both sides of the development roller 251. Tape-shaped spacers 253 are fixed to the toner non-feeding surfaces 251*b* and 251*c* of the development roller 251. The spacers 253 are brought into press contact with the image non-carrying surfaces 21*b* and 21*c* of the photosensitive drum 21, whereby a development gap g is formed between the toner carrying surface 251*a* of the development roller 251 and image carrying surface 21*a* of the photosensitive drum 21 facing the toner carrying surface 251*a*. The development gap g can be adjusted to a desired size by the thickness of the spacers 253. The spacer 253 is made of a material having elasticity and having moisture absorption characteristics higher than that of the development roller 251. The spacers 253 are fixed to the toner non-carrying surfaces 251*b* and 251*c* of the development roller 251 by adhesive layers 254 having elasticity.

The toner image visualized at the development position as described above is fed in the rotation direction of the photosensitive drum 21 and primary-transferred onto a transfer belt 8 (to be described later) at a primary transfer position at which the transfer belt 8 and respective photosensitive drums 21 are brought into contact with each other.

In the present embodiment, a photoreceptor cleaner 27 is provided at a position on the downstream side of the primary transfer position and on the upstream side of the charging section 23, with respect to the rotation direction of the photosensitive drum 21. The photoreceptor cleaner 27 is brought into contact with the surface of the photosensitive drum 21 and removes a residual toner on the surface of the photosensitive drum 21 after the primary transfer.

The transfer belt unit 8 has a driving roller 82, a driven roller 83 (blade opposing roller) provided on the left side of the driving roller 82 in FIG. 1, and a transfer belt 8 which is wound around the above rollers and is driven to rotate in the direction of an arrow (feeding direction). Provided inside the transfer belt 81 are four primary transfer rollers 85Y, 85M, 85C, and 85K which are disposed opposite, in a one-to-one relationship, to the respective photosensitive drums 21 of the respective image forming stations Y, M, C, and K in a state where a photoreceptor cartridge has been attached. The primary transfer rollers 85 are each electrically connected to a primary transfer bias generator (not shown). At the time of operation in the color mode, all the primary transfer rollers 85Y, 85M, 85C, and 85K are positioned relative to the respective image forming stations Y, M, C, and K as shown in FIG. 1. In this state, the transfer belt 8 is brought into contact with the photosensitive drums 21 of the respective image forming stations Y, M, C, and K to form the primary transfer positions between the photosensitive drums 21 and transfer belt 8. Then, a primary transfer bias is applied from the primary bias generators to the primary transfer rollers 85 at an appropriate timing to cause toner images formed on the surfaces of the respective photosensitive drums 21 to be transferred onto the surface of the transfer belt 8 at the primary transfer positions at which the primary transfer rollers 85 are brought into contact with the transfer belt 8, whereby a color image is formed.

On the other hand, at the time of operation in the monochrome mode, the color primary transfer rollers 85Y, 85M, and 85C of the four primary transfer rollers 85 are moved away from their opposing image forming stations Y, M, and C while only the monochrome primary transfer roller 85K is brought into contact with the image forming station K, allowing only the monochrome image forming station k to be brought into contact with the transfer belt 81. As a result, the primary transfer position is formed only at the position between the monochrome primary transfer roller 85K and image forming station K. Then, a primary transfer bias is applied from the primary transfer bias generator to the monochrome primary transfer roller 85K at an appropriate timing to cause a toner image formed on the surface of the photosensitive drum 21 to be transferred onto the surface of the transfer belt 81 at the primary transfer positions at which the monochrome primary transfer roller 85K is brought into contact with the transfer belt 81, whereby a monochrome image is formed.

The driving roller 82 drives the transfer belt 8 to rotate in the direction of an arrow in FIG. 1, as well as serves as a back-up roller of a secondary transfer roller 121. A rubber layer having a thickness of about 3 mm and a volume resistance of not more than 1000 kΩ-cm is formed on the peripheral surface of the driving roller 82 and is grounded through a metal shaft to thereby serve as a conductive path for a secondary transfer bias supplied from a secondary transfer bias generator (not shown) through the secondary transfer roller 121. The rubber layer has high friction characteristics and shock absorption characteristics, so that when a recording sheet enters the portion (secondary transfer position) at which the driving roller 82 and secondary transfer roller 121 are brought into contact with each other, an impact force is unlikely to transmit to the transfer belt 8, preventing image degradation.

Recording sheets stored in a sheet supply cassette 77 are supplied, one by one, therefrom by a pair of pickup rollers 79 to the secondary transfer position.

The secondary transfer roller 121, which can contact or separate from the transfer belt 81, is driven by a secondary transfer roller driving mechanism (not shown). A fixing unit 13 has a rotatable heating roller 131 incorporating a heat generator such as a halogen heater and a pressuring roller 132 for press-biasing the heating roller 131. The sheet onto the surface of which an image has been secondary-transferred is guided to a nip portion formed between the heating roller 131 and pressuring roller 132. The image is thermally fixed at the nip portion at a predetermined temperature. The recording sheet thus subjected to the image fixing processing is fed to a sheet discharge tray 4 provided on the upper surface of a housing main body 1.

In this image forming apparatus, a cleaner section 71 is disposed opposite to the driven roller 83. The cleaner section 71 has a cleaner blade 711 and a waste toner box 713. The cleaner blade 711 brings its leading end portion into contact with the driven roller 83 through the transfer belt 8 to thereby remove foreign matters such as toner or paper powder remaining on the transfer belt after the secondary transfer process. The removed foreign matters are collected in the waste toner box 713. The cleaner blade 711 and waste toner box 713 are integrally formed with the driven roller 83. Accordingly, in the case where the blade opposing roller 83 is moved, the cleaner blade 711 and waste toner box 713 are moved together with the blade opposing roller 83.

Figure 3:
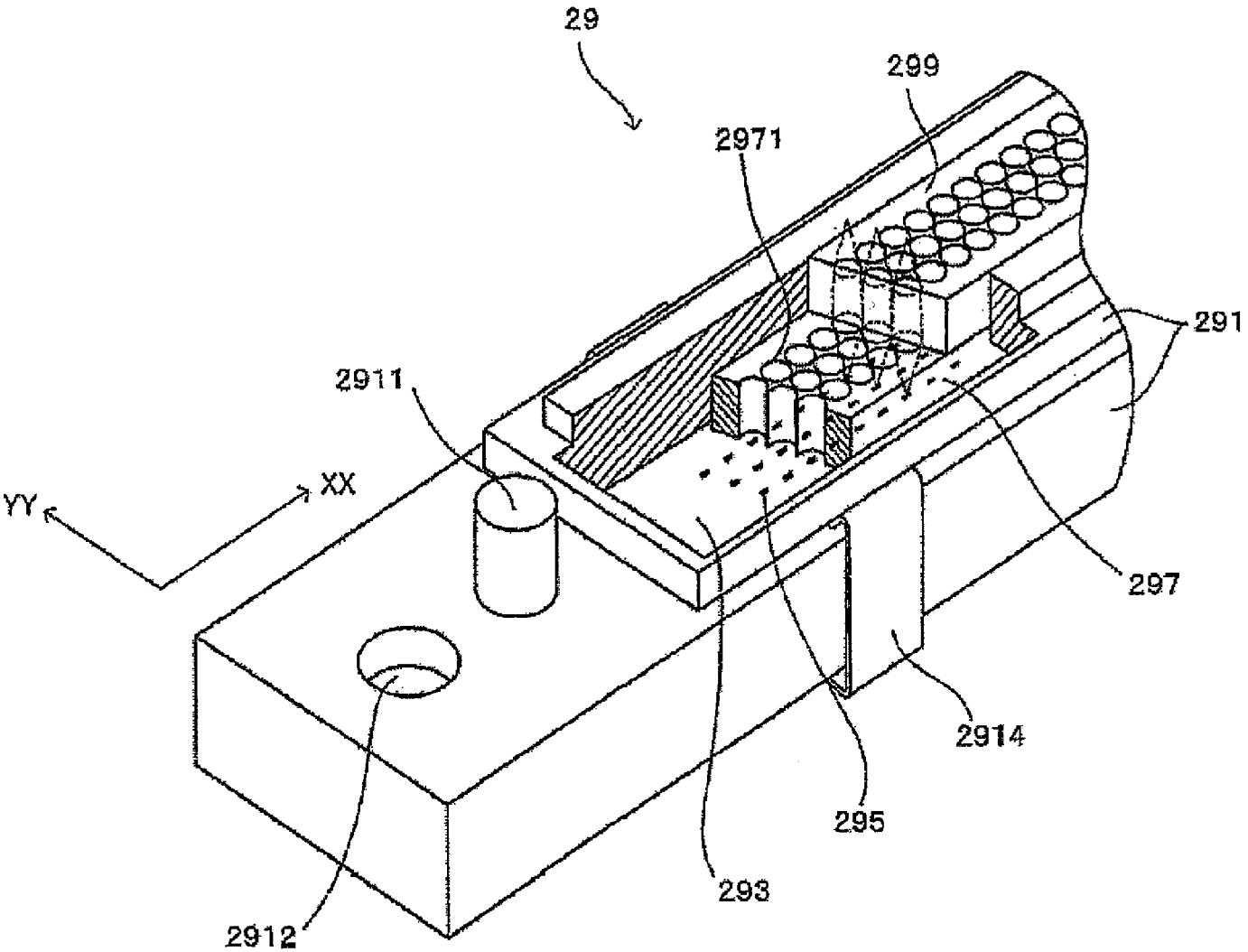
FIG. 3 is a perspective view showing an outline of an embodiment of a line head according to the present invention.
Figure 4:
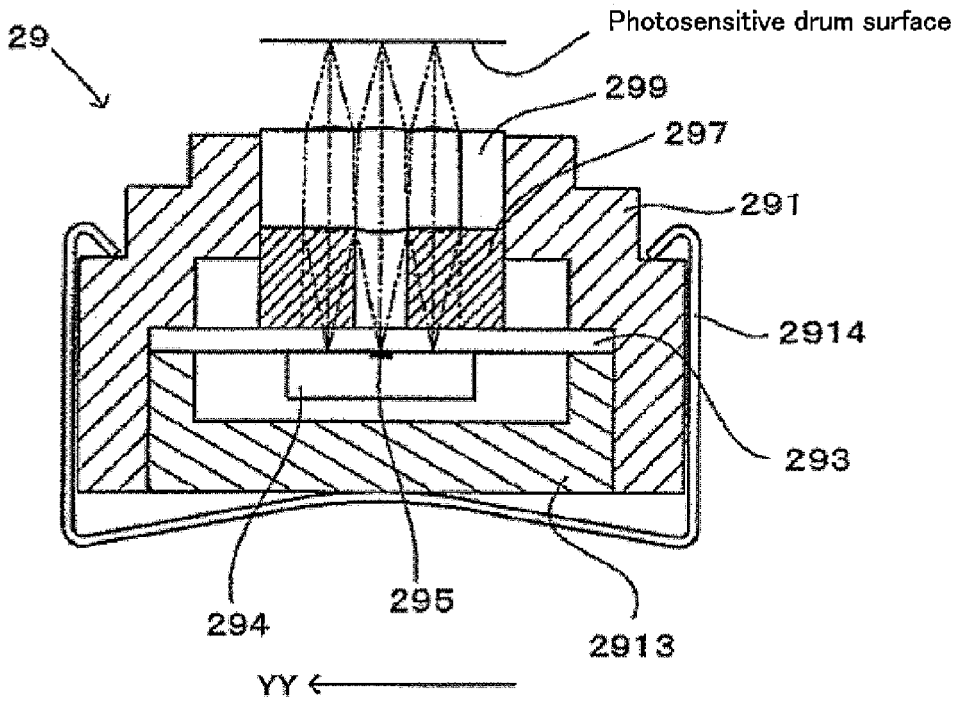
FIG. 4 is a cross-sectional view of the line head according to the present invention, taken in the sub-scanning direction thereof.

FIG. 3 is a perspective view showing an outline of an embodiment of the line head according to the present invention. FIG. 4 is a cross-sectional view of the line head according to the present invention, taken in the sub-scanning direction thereof. The line head 29 of the present embodiment has a case 291 elongated in the main scanning direction XX. A positioning pin 2911 and a screw insertion hole 2912 are provided on both sides of the case 291. The positioning pin 2911 is fitted in a positioning hole (not shown) formed in a photoreceptor cover (not shown) which covers the photosensitive drum 21 and is positioned relative thereto, whereby the positioning of the line head 29 relative to the photosensitive drum 21 is established. Further, a fixing screw is screwed, through the screw insertion hole 2912, into a screw hole (not shown) formed in the photoreceptor cover to fix the positioning between the line head 29 and photosensitive drum 21.

The case 291 retains a microlens array 299 at a position opposite to the surface of the photosensitive drum 21. Further, the case 291 has, inside thereof, a light shielding member 297 and a glass substrate 293 in the order closer to the microlens array 299. A plurality of light-emitting device groups 295 are provided on the back surface (surface on the reverse side where the microlens array 299 is disposed) of the glass substrate 293. That is, the plurality of light-emitting device groups 295 are two-dimensionally arranged on the back surface of the glass substrate 293 such that they are spaced apart from one another both in the main scanning direction XX and sub-scanning direction YY. As described later, a plurality of light-emitting devices are two-dimensionally arranged in each light-emitting device groups 295. In the present embodiment, an organic EL (Electro-Luminescence) is used as a light-emitting device. That is, in the present embodiment, the organic ELs are arranged on the back surface of the glass substrate 293. A light beam emitted from each of the light-emitting devices toward the photosensitive drum 21 passes through the glass substrate 293 and directed to the light shielding member 297.

A plurality of light guide holes 2971 are drilled in the shielding member 297 in a one-to-one correspondence with the light-emitting device groups 295. The light guide hole 2971 is substantially a column-shaped hole penetrating the light shielding member 297 with a line parallel to the normal line of the glass substrate 293 as a central axis. Thus, a light beam emitted from the light-emitting devices belonging to one light-emitting device group 295 is directed to the microlens array 299 through the same light guide hole 2971. That is, interference between the light beams emitted from the different light-emitting device groups 295 is prevented by the light shield member 297. The light beam that has passed through the light guide hole 2971 drilled in the light shielding member 297 is focused onto the surface of the photosensitive drum 21 as a spot by the microlens array 299. A concrete configuration of the microlens array 299 and focused state of the light beam achieved by means of the microlens array 299 will be described in detail later.

As shown in FIG. 4, a rear cover 2913 is pressed against the case 291 through the glass substrate 293 by a retainer 2914. That is, the retainer 2914 has an elastic force to press the rear cover 2913 against the case 291, thereby light-tightly sealing the inside of the case 291 such that the light does not leak from the inside of the case 291 and light is not introduced from the outside of the case 291. A plurality of retainers 2914 are provided in the longitudinal direction of the case 291. The light-emitting device group 295 is covered by a sealing member 294.

Figure 5:
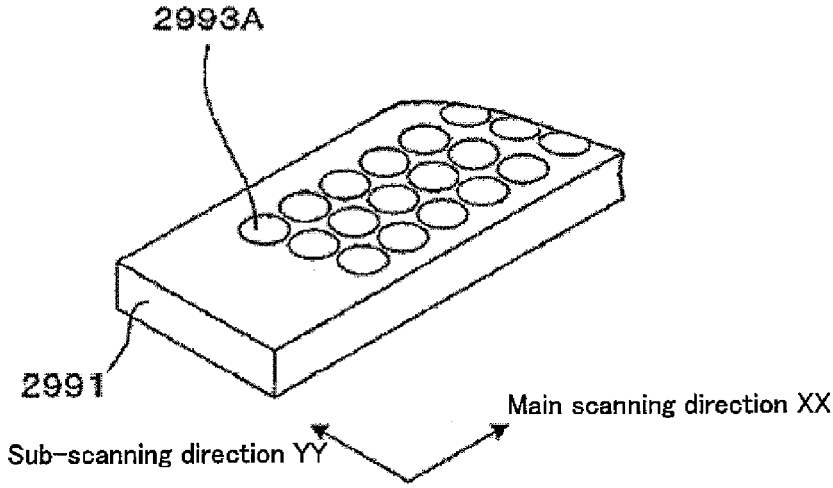
FIG. 5 is a perspective view showing an outline of a microlens array.
Figure 6:
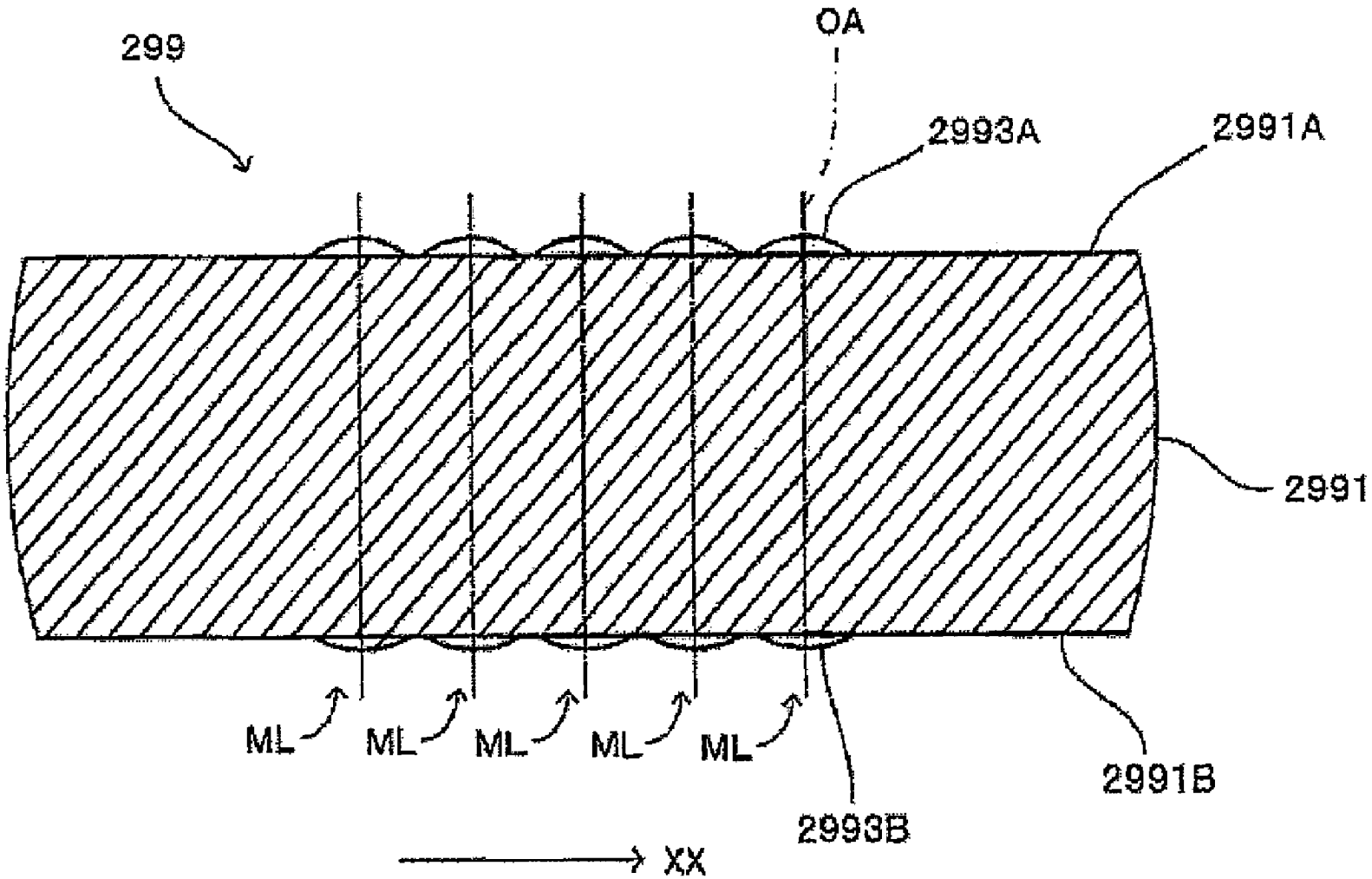
FIG. 6 is a cross-sectional view of the microlens array, taken in the main scanning direction thereof.

FIG. 5 is a perspective view showing an outline of the microlens array. FIG. 6 is a cross-sectional view of the microlens array, taken in the main scanning direction thereof. The microlens array 299 has a glass substrate 2991 and a plurality of lens pairs each constituted by two lenses 2993A and 2993B which are disposed opposite to each other across the glass substrate 2991. The lenses 2993A and 2993B may be made of a resin.

That is, a plurality of lenses 2993A are arranged on the front surface 2991A of the glass substrate 2991 and a plurality of lenses 2993B are arranged on the back surface 2991B of the glass substrate 2991 in a one-to-one correspondence with the lenses 2993A. The two lenses 2993A and 2993B constituting one lens pair have the same optical axis OA. The lens pairs correspond one-to-one to light-emitting device groups 295. In this specification, an optical system composed of the lens pair 2993A and 2993B and glass substrate 2991 sandwiched by the lens pair is referred to as "microlens ML". The plurality of lens pairs (microlenses ML) are two-dimensionally arranged in correspondence with the arrangement of the light-emitting device group 295 such that they are spaced apart from one another both in the main scanning direction XX and sub-scanning direction YY.

Figure 7:
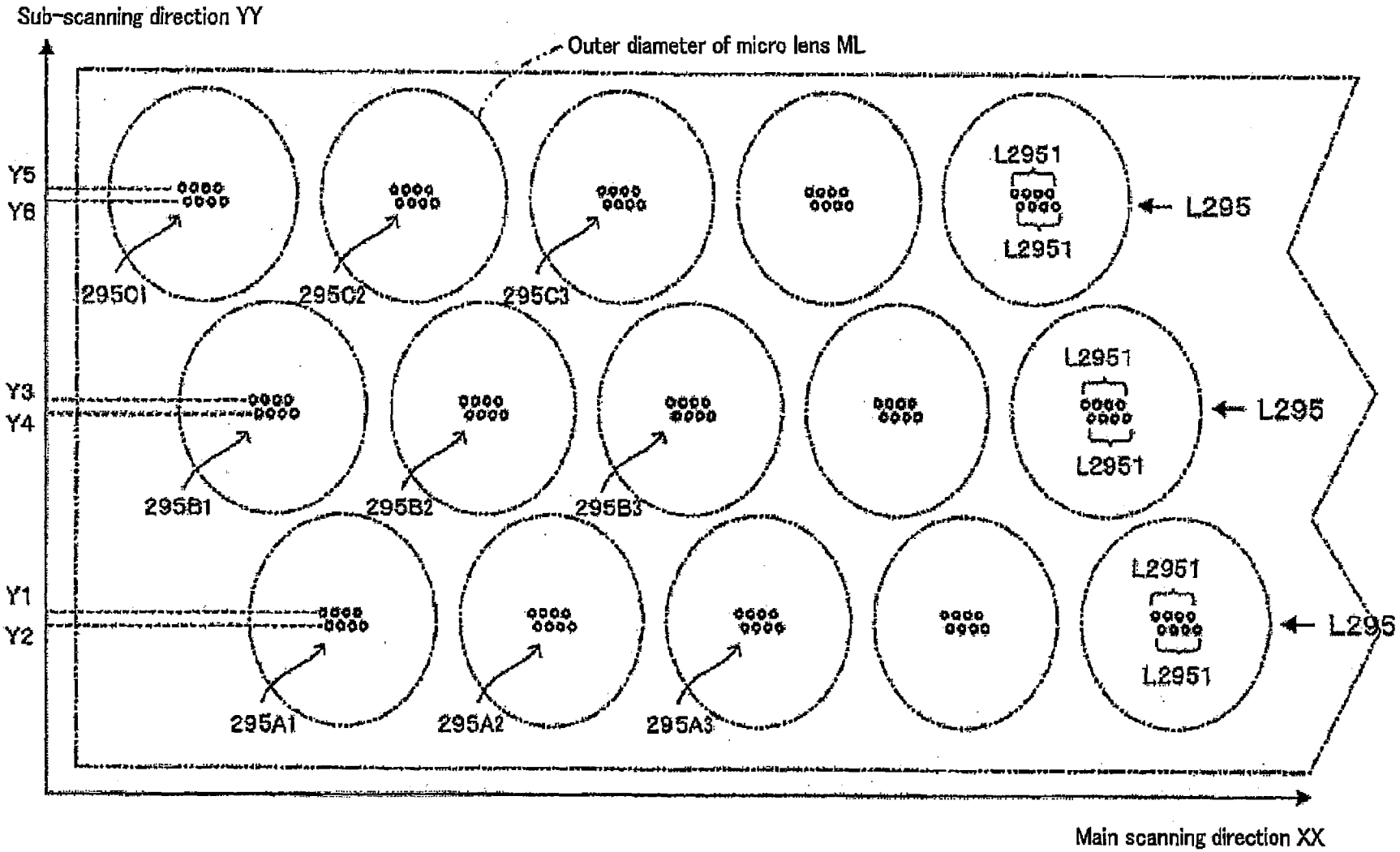
FIG. 7 is a view showing an arrangement of a plurality of light-emitting device groups.

FIG. 7 is a view showing an arrangement of the plurality of light-emitting device groups. In the present embodiment, two light-emitting device lines L2951 each including four light-emitting devices 2951 arranged at predetermined intervals in the main scanning direction XX are arranged in the sub-scanning direction YY to thereby constitute one light-emitting device group 295. That is, eight light-emitting devices 2951 constitute one light-emitting device group 295 in correspondence with the microlens ML denoted by a two-dot chain line of FIG. 7. The plurality of light-emitting device groups 295 are arranged as follows.

That is, the light-emitting device groups 295 are two-dimensionally arranged such that three light-emitting device group lines L295 including a predetermined number (two or more) of the light-emitting device groups 295 arranged in the main scanning direction XX are arranged in the sub-scanning direction YY. All the light-emitting device groups 295 are located at different positions in the main scanning direction. Further, the sub-scanning direction positions of two light-emitting device groups (e.g., light-emitting device groups 295C1 and 295B1) located at adjacent main scanning direction positions differ from each other. In the present specification, the geometric centroid of the light-emitting device 2951 is set to the position thereof. Thus, the distance between two light-emitting devices refers to a distance between the geometric centroids of the light-emitting devices. In the present specification, "geometric centroid of light-emitting device group" refers to the geometric centroid of the positions of all the light-emitting devices belonging to the same light-emitting device group 295. The main scanning direction position and sub-scanning direction position refer to a main scanning direction component and sub-scanning direction component at a target position, respectively.

The light guide holes 2971 are drilled in the shielding member 297 and lens pairs each constituted by two lenses 2993A and 2993B in a one-to-one correspondence with the light-emitting device groups 295. That is, in the present embodiment, the centroid position of the light-emitting device group 295, central axis of the light guide hole 2971, and optical axis OA of the lens pair constituted by the lenses 2993A and 2993B substantially coincide with one another. A light beam emitted from the light-emitting device 2951 of the light-emitting device group 295 enters the microlens array 299 through the corresponding light guide hole 2971 and is then focused onto the surface of the photosensitive drum 21 by the microlens array 299 as a spot.

Figure 8:
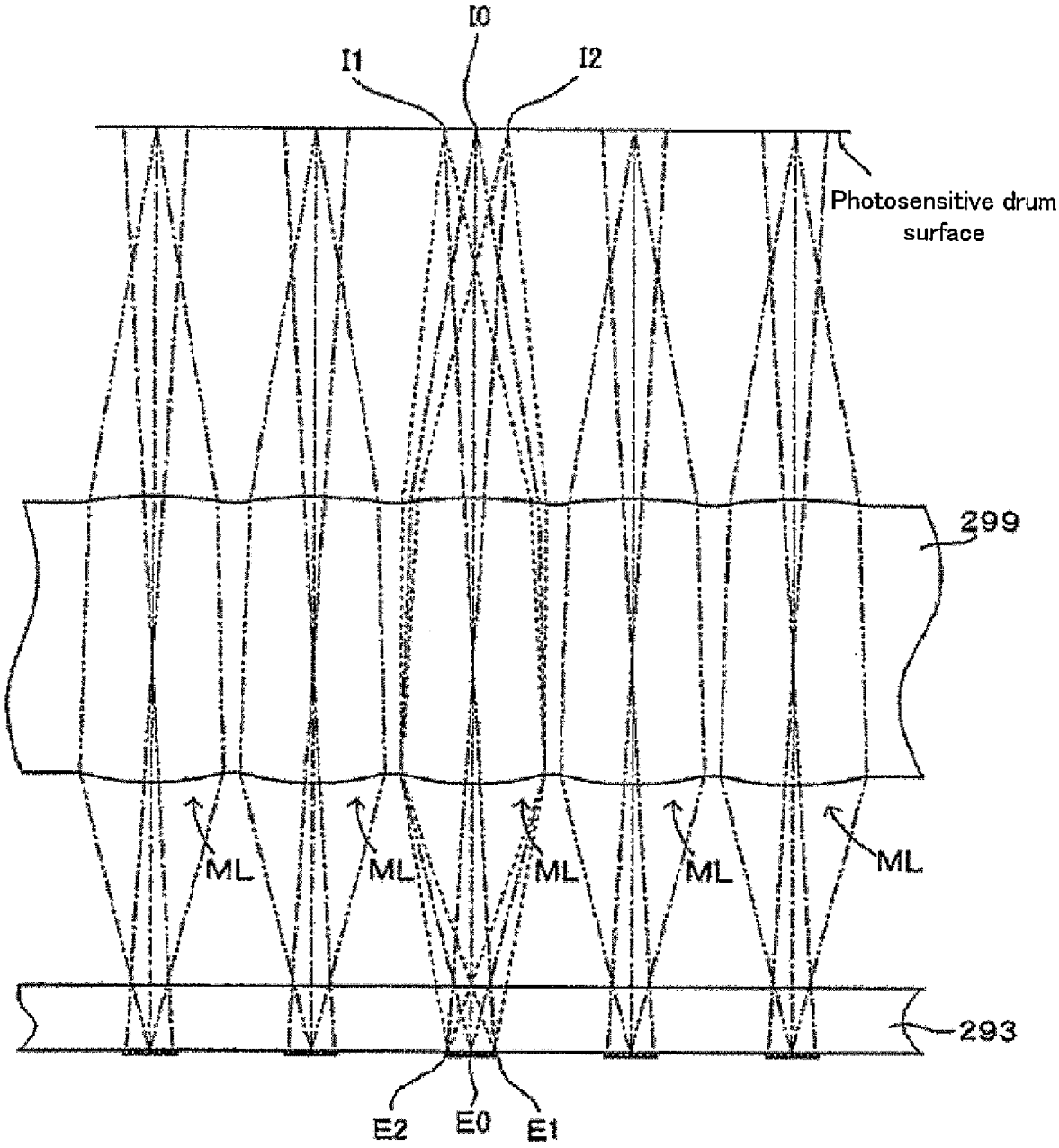
FIG. 8 is a focusing state of the microlens array.

FIG. 8 is a focusing state of the microlens array in the present embodiment. In FIG. 8, trajectories of light beams emitted from the geometric centroid E0 and positions E1, E2 each away from the geometric centroid E0 by a predetermined interval are shown for the purpose of representing the focusing characteristics of the microlens array 299. As shown by the trajectories, the light beams emitted from the respective positions enter the back surface of the glass substrate 293 and then emitted from the front surface of the glass substrate 293. Then, the emitted light beams reach the photosensitive drum surface (surface to be scanned) through the microlens array 299.

As shown in FIG. 8, the light beam emitted from the geometric centroid position E0 of the light-emitting device group is focused onto an intersecting point I0 between the surface of the photosensitive drum 21 and optical axis OA of the lenses 2993A and 2993B. This results from a fact that, as described above, the geometric centroid position E0 (position of the light-emitting device group 295) of the light-emitting device group 295 is set on the optical axis OA of the lenses 2993A and 2993B. The light beams emitted from the positions E1 and E2 are focused onto positions I1 and I2 on the surface of the photosensitive drum 21, respectively. More specifically, the light beam emitted from the position E1 is focused onto the position I1 on the opposite side with respect to the optical axis OA of the lenses 2993A and 2993B in the main scanning direction XX, and the light beam emitted from the position E2 is focused onto the position I2 on the opposite side with respect to the optical axis OA of the lenses 2993A and 2993B in the main scanning direction XX. That is, a focusing lens including the lens pair constituted by the lenses 2993A and 2993B having the same optical axis and glass substrate 2991 sandwiched by the lens pair is a so-called inverting optical system having inverting characteristics.

As shown in FIG. 8, the distance between the positions I1 and I0 at which the light beams are focused is larger than distance between the positions E1 and E0. That is, in the present embodiment, the absolute value of the magnification (optical magnification) of the optical system is larger than 1, which means that the optical system according to the present embodiment is an enlarging optical system having enlarging characteristics. As described above, in the present embodiment, the microlens ML which is an optical system including the lens pair constituted by the lenses 2993A and 2993B having the same optical axis and glass substrate 2991 sandwiched by the lens pair functions as a "focusing lens" in the present invention.

Figure 9:
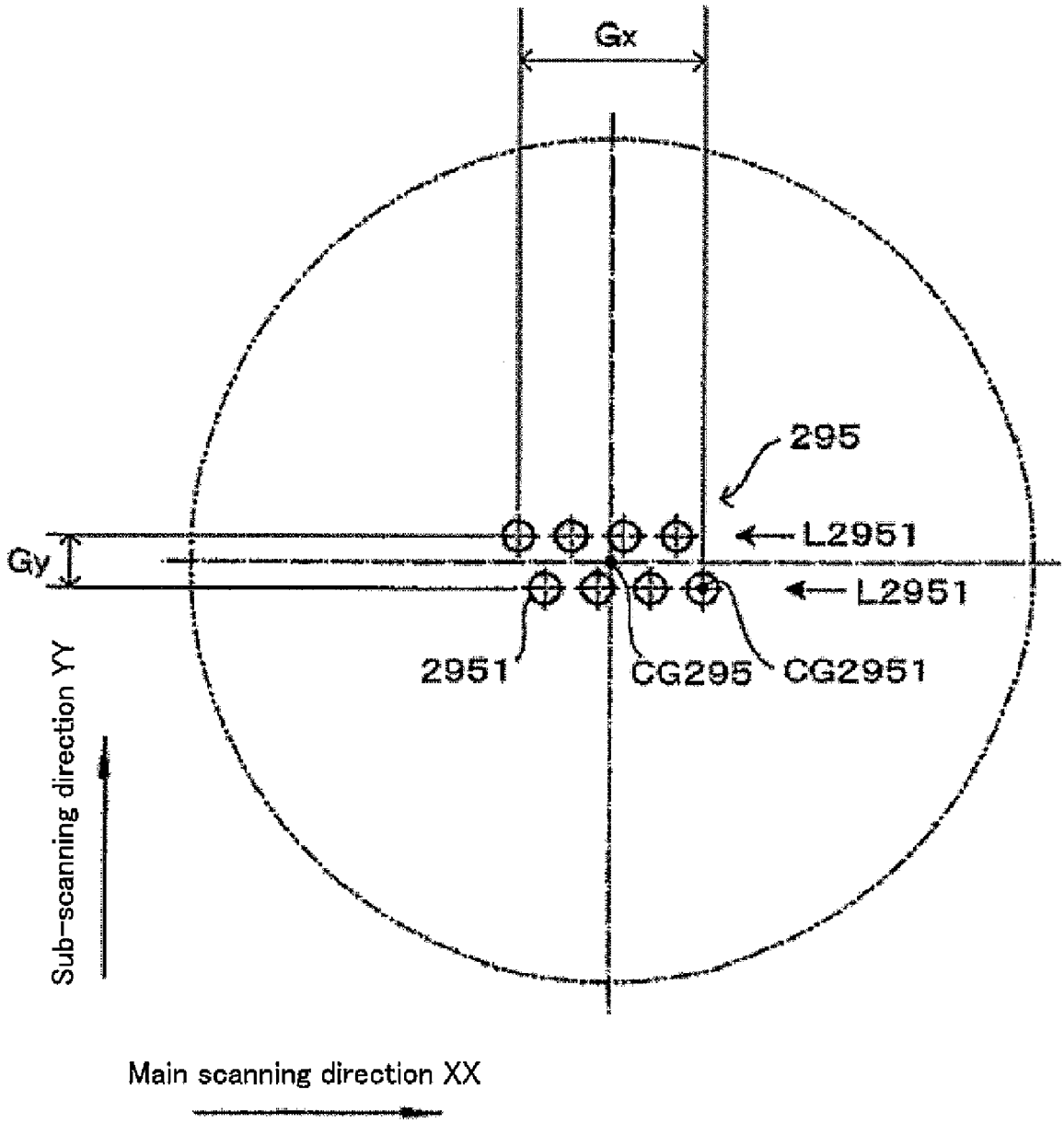
FIG. 9 is a view showing a detail of the arrangement of the light-emitting devices.

FIG. 9 is a view showing a detail of the arrangement of the light-emitting devices. In FIG. 9, a reference symbol CG2951 denotes the geometric centroid (position of light-emitting device 2951) of the light-emitting device 2951. Further, a reference symbol CG295 denotes the geometric centroid (geometric centroid of light-emitting device group 295) of all the positions of eight light-emitting devices 2951 belonging to the light-emitting device group 295. As shown in FIG. 9, in the present embodiment, eight light-emitting devices 2951 are two-dimensionally arranged such that the two light-emitting device lines L2951 including four light-emitting devices arranged in the main scanning direction XX at predetermined intervals are arranged in the sub-scanning direction YY. The two light-emitting device lines L2951 are arranged in the sub-scanning direction YY such that, within the same light-emitting device group, positions of the main scanning direction XX of eight light-emitting devices 2951 differ from one another and two light-emitting devices 2951 whose positions of the main scanning direction XX are adjacent to each other belong to different light-emitting device lines L2951. As described above, in the present embodiment, eight light-emitting devices 2951 belonging to the same light-emitting device group correspond to "a plurality of light-emitting devices" in the present invention.

In FIG. 9, a reference symbol Gx denotes the distance (main scanning group width) between the position of the upstreammost light-emitting device 2951 and that of the downstreammost light-emitting device 2951 in the main scanning direction XX in one light-emitting device group 295. Further, a reference symbol Gy denotes the distance (sub-scanning group width) between the position of the upstreammost light-emitting device 2951 and that of the downstreammost light-emitting device 2951 in the sub-scanning direction YY in one light-emitting device group 295. As shown in FIG. 9, the main scanning group width Gx is set larger than the sub-scanning group width Gy in the present embodiment. That is, each light-emitting device group 295 has a flattened arrangement structure with the main scanning direction XX as a longitudinal axis. Specifically, in the present embodiment, Gx and Gy are set to 0.148 mm and 0.021 mm, respectively.

Figure 10:
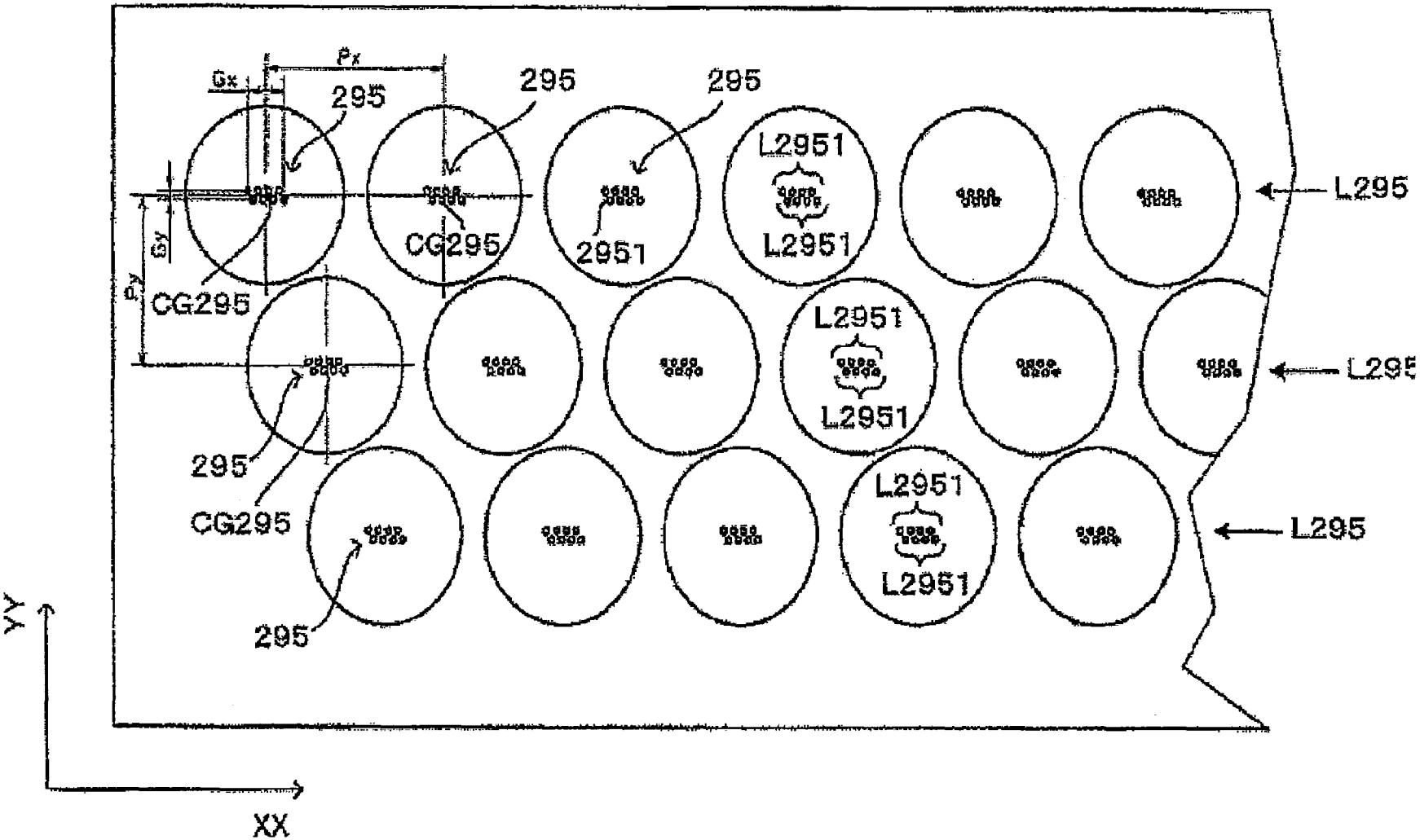
FIG. 10 is a view showing a relationship between adjacent light-emitting device groups.

FIG. 10 is a view showing a relationship between adjacent light-emitting device groups in the present embodiment. In FIG. 10, a reference symbol Px denotes the distance (main scanning group pitch) between the geometric centroids CG295 of two light-emitting device groups 295 whose positions of the main scanning direction XX are adjacent to each other. Further, a reference symbol Py denotes the distance (sub-scanning group pitch) between the geometric centroids CG295 of two light-emitting device groups 295 whose positions of the sub-scanning direction YY are adjacent to each other. Further, as can be understood from FIG. 10, the main scanning group pitch Px is set larger than the sub-scanning group pitch Py in the present embodiment. Specifically, in the present embodiment, Px and Py are set to 1.016 mm and 0.9 mm, respectively.

Figure 11:
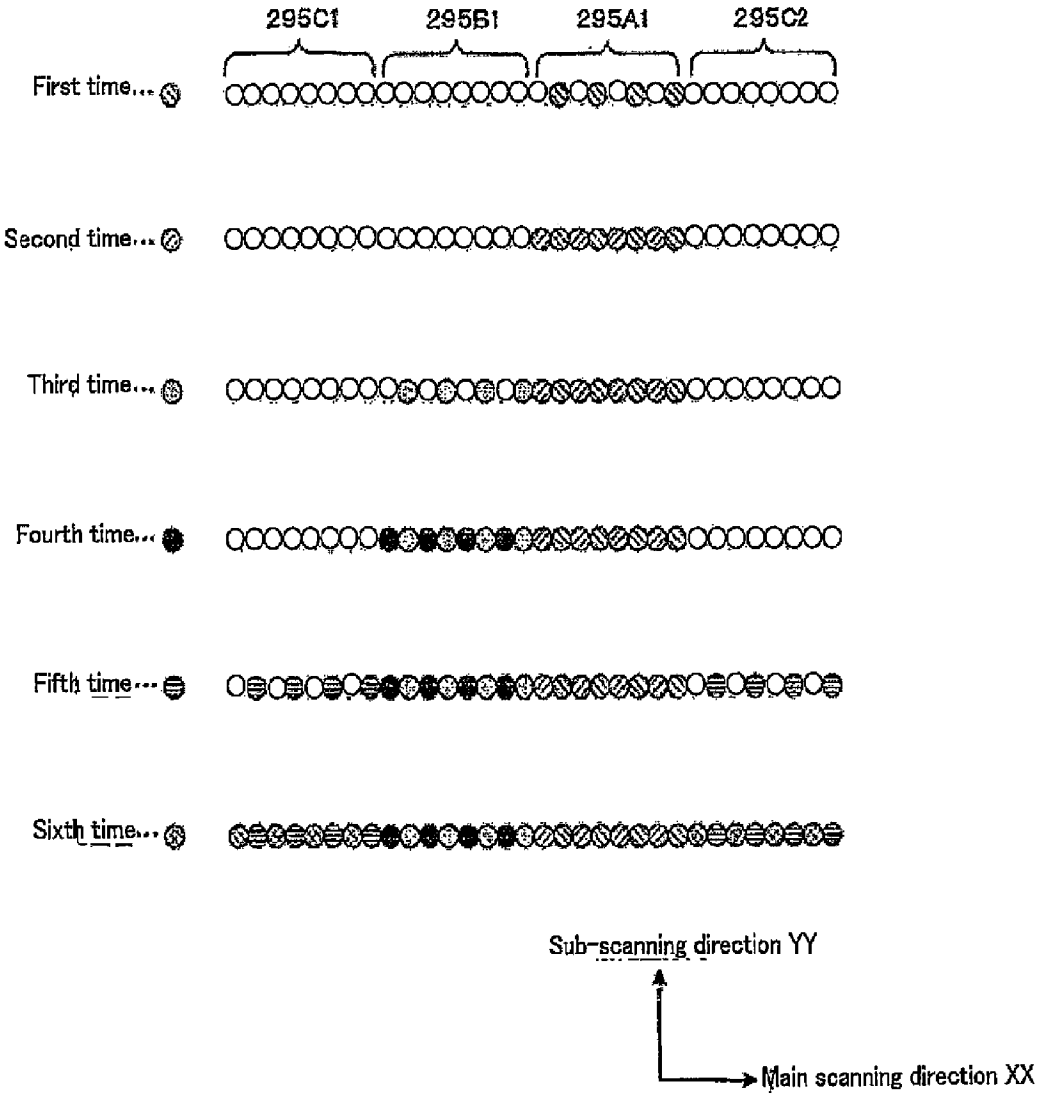
FIG. 11 is a view showing spot formation operation performed by the line head.

FIG. 11 is a view showing spot formation operation performed by the line head. In the following, the spot formation operation performed by the line head will be described using FIG. 7 and FIG. 11. For easy understanding of the invention, it is assumed that a plurality of spots are formed and arranged on a straight line extending in the main scanning direction XX. In the present embodiment, the surface (surface to be scanned) of the photosensitive drum 21 (latent image carrier) is fed in the sub-scanning direction YY, and a plurality of light-emitting devices are turned on to emit light at a predetermined timing, and whereby a plurality of spots are formed and arranged on the straight line extending in the main scanning direction XX.

That is, in the line head according to the present embodiment, six light-emitting device lines L2951 are arranged in the sub-scanning direction YY in correspondence with respective sub-scanning direction positions Y1 to Y6 (see FIG. 7). Thus, in the present embodiment, the light-emitting device lines L2951 on the same sub-scanning direction position are turned on at substantially the same timing, while the light-emitting device lines L2951 on different sub-scanning direction positions are turned on to emit light at different timings. More specifically, the light-emitting device lines L2951 are sequentially turned on to emit light in the order of the sub-scanning direction positions Y1 to Y6. Thus, the light-emitting device lines L2951 are sequentially turned on to emit light in the order described above while the surface of the photosensitive drum 21 is fed in the sub-scanning direction YY, whereby a plurality of spots are formed and arranged on the straight line extending on the surface in the main scanning direction XX.

The above operation will be described in more detail using FIG. 7 and FIG. 11. First, the light-emitting devices 2951 of the light-emitting device lines L2951 on the sub-scanning direction position Y1 which belong to the sub-scanning direction YY upstreammost light-emitting device groups 295A1, 295A2, 295A3, . . . , are turned on to emit light. A plurality of light beams emitted by the above operation are inversed and enlarged by the "focusing lens" having the abovementioned inverting/enlarging characteristics and then focused onto the photosensitive drum surface. That is, spots are formed on the positions of hatching pattern of "first operation" of FIG. 11. In FIG. 11, white circles denote spots that have not yet been formed (i.e., spots to be formed in the subsequent operation). Further, in FIG. 11, spots labeled with reference symbols 295C1, 295B1, 295A1, and 295C2 are spots formed by the light-emitting device group 295 corresponding to the reference symbols respectively given thereto.

Subsequently, the light-emitting devices 2951 of the light-emitting device lines L2951 on the sub-scanning direction position Y2 which belong to the same light-emitting device groups 295A1, 295A2, 295A3, . . . , are turned on to emit light. A plurality of light beams emitted by the above operation are inversed and enlarged by the "focusing lens" having the abovementioned inverting/enlarging characteristics and then focused onto the photosensitive drum surface. That is, spots are formed on the positions of hatching pattern of "second operation" of FIG. 11. The reason that the light-emitting device line L2951 on the sub-scanning direction YY downstream side is turned on first (i.e., the light-emitting device lines L2951 are tuned on in the order of the sub-scanning direction position Y1 and sub-scanning direction position Y2) even though the feeding direction of the photosensitive drum 21 surface is the sub-scanning direction YY is that the "focusing lens" has inverting characteristics.

Subsequently, the light-emitting devices 2951 of the light-emitting device lines L2951 on the sub-scanning direction position Y3 which belong to the sub-scanning direction second upstreammost light-emitting device groups 295B1, 295B2, 295B3, . . . , are turned on to emit light. A plurality of light beams emitted by the above operation are inversed and enlarged by the "focusing lens" having the above-mentioned inverting/enlarging characteristics and then focused onto the photosensitive drum surface. That is, spots are formed on the positions of hatching pattern of "third operation" of FIG. 11.

Subsequently, the light-emitting devices 2951 of the light-emitting device lines L2951 on the sub-scanning direction position Y4 which belong to the same light-emitting device groups 295B1, 295B2, 295B3, . . . , are turned on to emit light. A plurality of light beams emitted by the above operation are inversed and enlarged by the "focusing lens" having the abovementioned inverting/enlarging characteristics and then focused onto the photosensitive drum surface. That is, spots are formed on the positions of hatching pattern of "fourth operation" of FIG. 11.

Subsequently, the light-emitting devices 2951 of the light-emitting device lines L2951 on the sub-scanning direction position Y5 which belong to the sub-scanning direction downstreammost light-emitting device groups 295C1, 295C2, 295C3, . . . , are turned on to emit light. A plurality of light beams emitted by the above operation are inversed and enlarged by the "focusing lens" having the abovementioned inverting/enlarging characteristics and then focused onto the photosensitive drum surface. That is, spots are formed on the positions of hatching pattern of "fifth operation" of FIG. 11.

Finally, the light-emitting devices 2951 of the light-emitting device lines L2951 on the sub-scanning direction position Y6 which belong to the same light-emitting device groups 295C1, 295C2, 295C3, . . . , are turned on to emit light. A plurality of light beams emitted by the above operation are inversed and enlarged by the "focusing lens" having the abovementioned inverting/enlarging characteristics and then focused onto the photosensitive drum surface. That is, spots are formed on the positions of hatching pattern of "sixth operation" of FIG. 11. As described above, by executing the above first to sixth light emitting operations, a plurality of spots are formed and arranged on the straight line extending in the main scanning direction XX.

As described above, the line head according to the present embodiment includes: a plurality of the light-emitting device groups 295 each having a plurality of the light-emitting devices 2951; and a plurality of microlenses ML (focusing lens) which are arranged in one-to-one correspondence with the light-emitting device groups 295 and each focus the light beams emitted from the respective light-emitting devices 2951 belonging to the corresponding light-emitting device groups 295 onto the photosensitive drum surface (surface to be scanned). The plurality of light-emitting device groups 295 and light-emitting devices 2951 are arranged as follows. That is, the light-emitting device groups 295 are two-dimensionally arranged such that a plurality of the light-emitting device group lines L295 including two or more light-emitting device groups 295 arranged in the main scanning direction XX are arranged in the sub-scanning direction YY. The light-emitting devices 2951 belonging to the same light-emitting device group 295 are two-dimensionally arranged such that a plurality of the light-emitting device lines L2951 including two or more light-emitting devices 2951 arranged in the main scanning direction XX are arranged in the sub-scanning direction YY.

The line head 29 is configured such that the main scanning group width Gx is larger than the sub-scanning group width Gy. Since, in the line head 29, the light-emitting device group 295 has a flattened arrangement structure with the main scanning direction XX as a longitudinal axis, crosstalk in the main scanning direction XX may occur. That is, in the case where the light-emitting device group has the configuration described above, the distance Δ between the light-emitting device 2951 located at the main scanning direction end of the light-emitting device group 295 and focus lens adjacent in the main scanning direction XX to the focus lens corresponding to the light-emitting device 2951 tends to be small. Thus, crosstalk in the main scanning direction XX may occur, where the light beam emitted from the light-emitting device 2951 located at the end of the light-emitting device group 295 enters also the focus lens adjacent in the main scanning direction to the focus lens corresponding to the light-emitting device 2951. The occurrence of such crosstalk may prevent a satisfactory spot from being formed. In the following, this problem and a means for solving the problem will be described with reference to the drawings.

Figure 12:
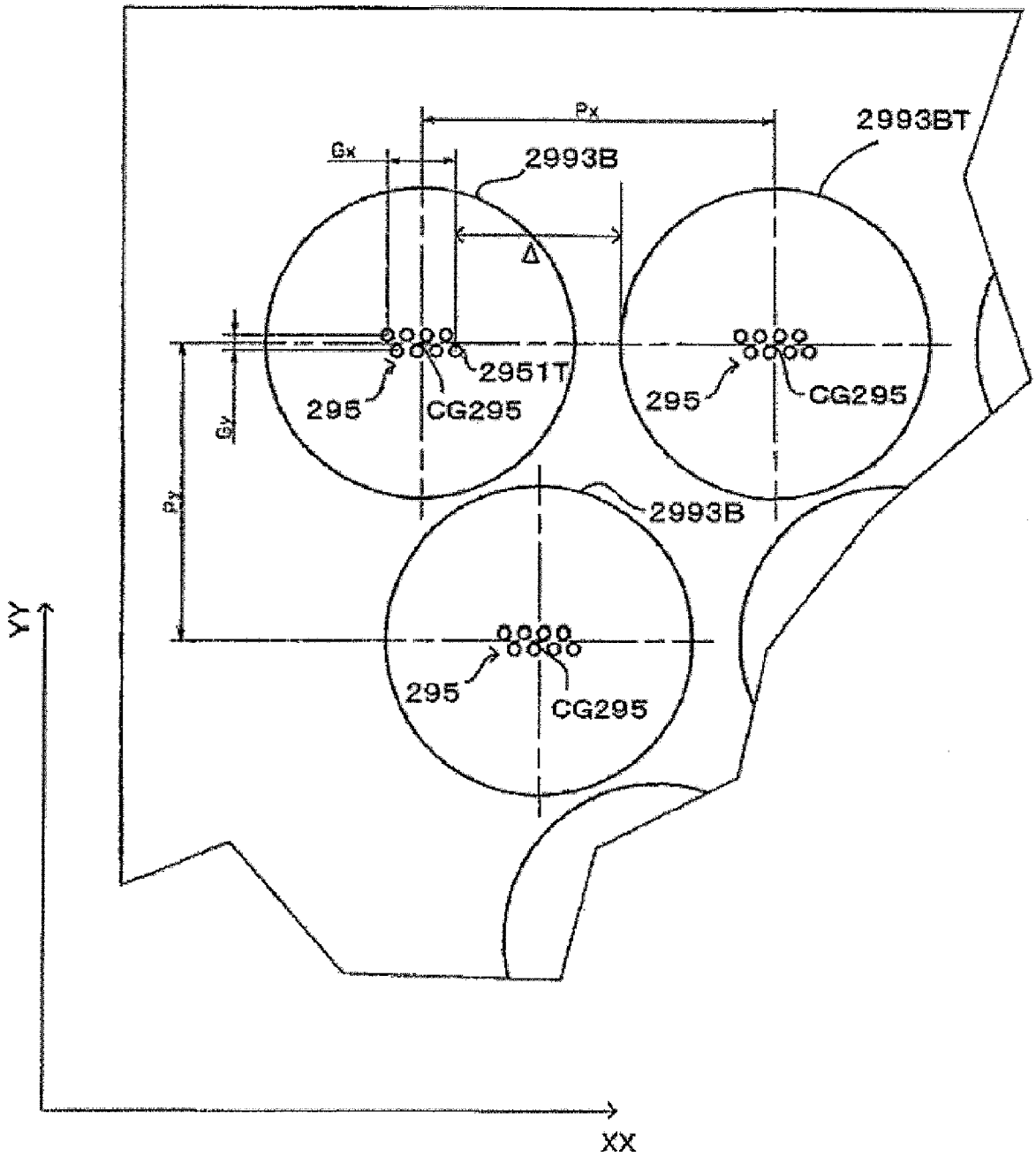
FIG. 12 is a view schematically showing the principle of the present invention.

FIG. 12 is a view schematically showing the principle of the present invention. In FIG. 12, solid line circles 2993B and 2993BT each denote the lens 2993B constituting the microlens ML (focusing lens). As described above, the lens 2993B is arranged in correspondence with the light-emitting device group 295. Like the line head according to the present embodiment, in the case where the light-emitting device 295 has a flattened arrangement structure with the main scanning direction XX as a longitudinal axis, crosstalk in the main scanning direction XX may occur. That is, the light beam emitted from the light-emitting device 2951T located at the end of the light-emitting device group 295 may enter also the focus lens adjacent in the main scanning direction XX to the focus lens corresponding to the light-emitting device 2951T through the lens 2993BT. To cope with this problem, the line head according to the present invention is configured as follows. That is, assuming that the distance between the geometric centroids CG295 of two light-emitting device groups 295 whose positions of the main scanning direction XX are adjacent to each other is defined as main scanning group pitch Px and distance between the geometric centroids CG295 of two light-emitting device groups 295 whose positions of the sub-scanning direction YY are adjacent to each other is defined as sub-scanning group pitch Py, the main scanning group pitch Px is set larger than the sub-scanning group pitch Py. Thus, the distance Px between the two light-emitting device groups 295 whose main scanning direction positions are adjacent to each other can sufficiently be ensured. As a result, the distance Δ between the light-emitting device 2951T located at the main scanning direction end of the light-emitting device group 295 and focus lens adjacent in the main scanning direction XX to the focus lens corresponding to the light-emitting device 2951T can also sufficiently be ensured. Therefore, it is possible to prevent occurrence of the crosstalk in the main scanning direction XX where the light beam emitted from the light-emitting device 2951T located at the end of the light-emitting device group 295 enters also the focus lens adjacent in the main scanning direction XX to the focus lens corresponding to the light-emitting device 2951T, whereby a satisfactory spot can be formed.

The line head 29 focuses a light beam emitted from the light-emitting device 2951 of the light-emitting device group 295 using the microlens ML (focusing lens) to thereby form a spot on the surface to be scanned. At this time, the line head 29 so forms the spots as to achieve a predetermined resolution. More specifically, the distance between spots adjacently disposed on the surface to be scanned is so set as to achieve a predetermined resolution. Thus, to achieve the distance between the adjacent spots, the focusing lens focuses light beams emitted from the plurality of light-emitting devices 2951 of the light-emitting device group 295 onto the surface to be scanned as spots at a predetermined magnification (optical magnification). The line head 29 according to the embodiment uses, as a focusing lens, the enlarging optical system having an absolute value of the magnification of more than 1. Thus, occurrence of the crosstalk in the main scanning direction XX can effectively be prevented, whereby a more satisfactory spot can be formed. The reason for this will next be described.

First, in attempting to explain the above reason, a description will be given of a configuration of the light-emitting device group 295 required for achieving the abovementioned resolution in both cases where the focusing lens is an enlarging optical system (focusing lens having an absolute value of the magnification is more than 1) and where the focusing lens is a reducing optical system (focusing lens having an absolute value of the magnification is less than 1). In the case where the focusing lens is an enlarging optical system, light beams emitted from two light-emitting devices 2951 adjacent to each other in the main scanning direction XX are enlarged and focused, as two spots, onto the photoreceptor surface (surface to be scanned). That is, the distance between the two spots on the photoreceptor surface is larger than that between the two light-emitting devices. On the other hand, in the case where the focusing lens is a reducing optical system, the relationship of the distance between the two spots and distance between the two light-emitting devices becomes reverse to the case where the enlarging optical system is used. That is, the distance between the two spots on the photoreceptor surface is smaller than that between the two light-emitting devices. Thus, in order to achieve the same resolution level (that is, in order to achieve the same distance between the two spots), it is necessary to set the distance between two light-emitting devices adjacent to each other in the main scanning direction XX to be small in the case where the enlarging optical system is used; while it is necessary to set the distance between two light-emitting devices adjacent to each other in the main scanning direction XX to be large in the case where the reducing optical system is used. As a result, the light-emitting device group 295 having a small main scanning direction width Gx is required in the case where the enlarging optical system is used; while the light-emitting device group 295 having a large main scanning direction width Gx is required in the case where the reducing optical system is used.

Thus, in the line head according to the embodiment, the absolute value of the magnification of the focusing lens is set larger than 1. Because this configuration allows more effective prevention of occurrence of the crosstalk in the main scanning direction XX where the light beam emitted from the light-emitting device 2951T located at the end of the light-emitting device group 295 enters also the focus lens adjacent in the main scanning direction to the focus lens corresponding to the light-emitting device 2951T, thus enabling more satisfactory spot to be formed. That is, as described above, in the case where the enlarging optical system is used as the focusing lens, the main scanning group width Gx of the light-emitting device group 295 can be set smaller. Accordingly, it is possible to increase the distance Δ between the light-emitting device 2951T located at the end of the main scanning direction XX of the light-emitting device group 295 and focus lens adjacent in the main scanning direction XX to the focus lens corresponding to the light-emitting device 2951T. As a result, it is possible to more effectively prevent occurrence of the crosstalk in the main scanning direction XX where the light beam emitted from the light-emitting device 2951 located at the end of the light-emitting device group 295 enters also the focus lens adjacent in the main scanning direction to the focus lens corresponding to the light-emitting device 2951, thus enabling more satisfactory spot to be formed.

In the above embodiment, in one light-emitting device group 295, a plurality of light-emitting devices 2951 belonging to the light-emitting device group 295 are symmetrically arranged with respect to the geometric centroid CG295 of the light-emitting device group 295. Further, the position of the light-emitting device group 295 is set on the optical axis OA of the corresponding focusing lens. This configuration allows more effective prevention of occurrence of the crosstalk in the main scanning direction XX where the light beam emitted from the light-emitting device 2951 located at the end of the light-emitting device group 295 enters also the focus lens adjacent in the main scanning direction XX to the focus lens corresponding to the light-emitting device 2951, thus enabling more satisfactory spot to be formed. The reason for this will be described below.

Figure 13:
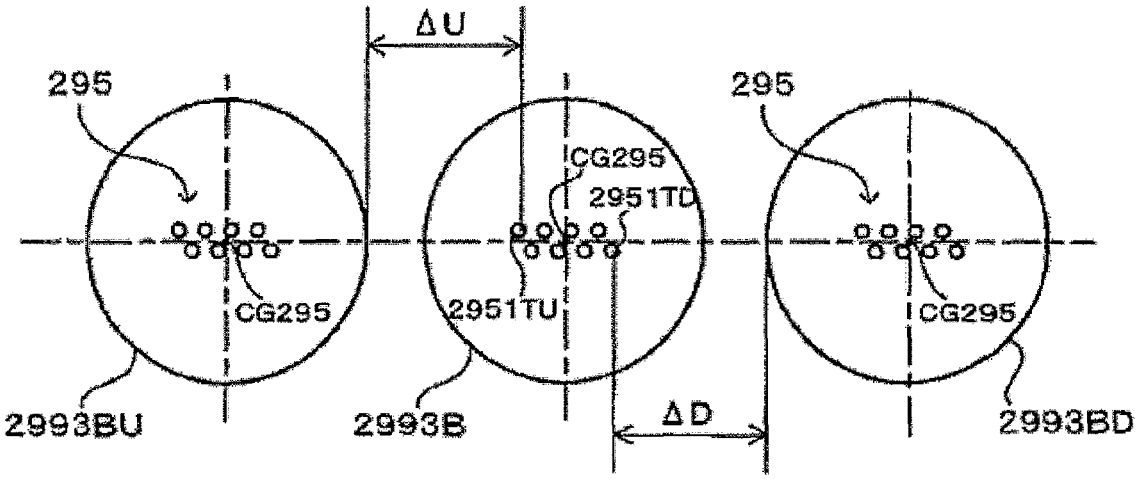
FIG. 13 is a view showing a case where the position of the light-emitting device group coincides with the optical axis of a focusing lens.
Figure 14:
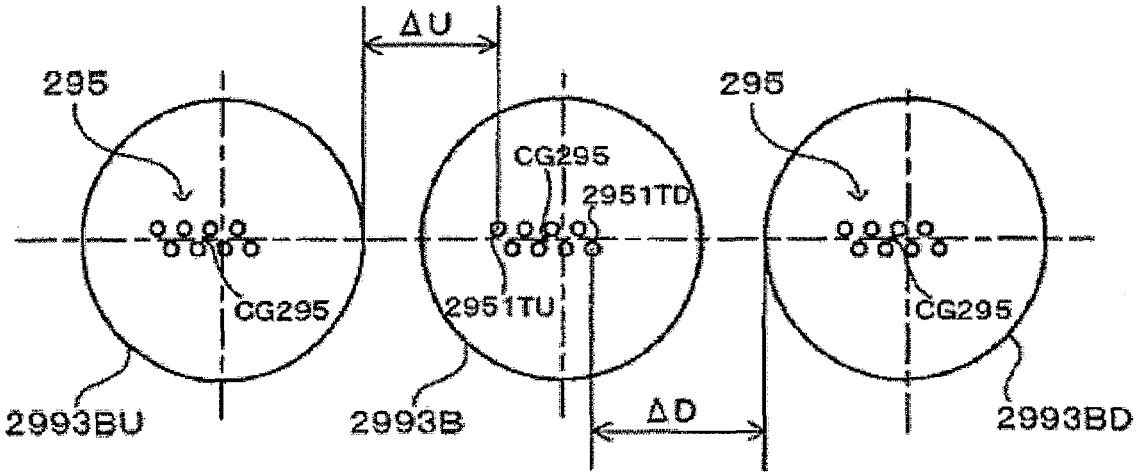
FIG. 14 is a view showing a case where the position of the light-emitting device group does not coincide with the optical axis of a focusing lens.

FIG. 13 is a view showing a case where the position of the light-emitting device group coincides with the optical axis of the focusing lens. FIG. 14 is a view showing a case where the position of the light-emitting device group does not coincide with the optical axis of an imaging lens. The light-emitting device group 295 has the light-emitting device 2951 on both sides of the main scanning direction. Further, in the line head 29 having the configuration described above, a plurality of light-emitting devices 2951 are symmetrically arranged with the position of the light-emitting device group 295 as a symmetric axis, and the optical axis OA (optical axis of the lens 2993B) of the focusing lens and above symmetric axis coincide with each other. In FIG. 13, the optical axis OA of the focusing lens is positioned at substantially the center of each of the lenses 2993B (that is, positioned on the intersection of two dot-and-dash lines extending in both horizontal and vertical directions). Thus, in the line head 29 having the configuration described above, the distance between the optical axis OA of the focusing lens and light-emitting device 2951TD located on the main scanning direction one end of the light-emitting device group 295 and distance between the optical axis OA of the focusing lens and light-emitting device 2951TU located on the main scanning direction other end of the light-emitting device group 295 are equal to each other. Accordingly, the distance ΔU between the light-emitting device 2951TU located on the main scanning direction other end and lens 2993BU and distance ΔD between the light-emitting device 2951TD located on the main scanning direction one end and lens 2993BD are equal to each other.

On the other hand, in the case where the symmetric axis of the light-emitting device group 295 and optical axis OA of the focusing lens do not coincide with each other, and the symmetric axis is displaced from the optical axis in any main scanning direction, that is, in the case of FIG. 14, the distance relationship differs from the above case. In FIG. 14, the geometric centroid CG295 of the light-emitting device group is displaced from the optical axis OA (optical axis of the lens 2993) of the focusing lens toward the main scanning direction XX upstream side. Accordingly, the distance ΔU between the light-emitting device 2951TU located on the main scanning direction other end and lens 2993BU is smaller than the distance ΔD between the light-emitting device 2951TD located on the main scanning direction one end and lens 2993BD. That is, the distance between the light-emitting device 2951TU and focusing lens becomes smaller. As a result, a light beam emitted from the light-emitting device 2951TU is more likely to enter the lens 2993BU. That is, the crosstalk in the main scanning direction XX is more likely to occur.

As described above, in the case where the geometric centroid CG295 of the light-emitting device group does not coincide with the optical axis OA of the corresponding focusing lens, the crosstalk in the main scanning direction XX is more likely to occur. To cope with this, in the above embodiment, the position of the light-emitting device group 295 is set on the optical axis OA of the corresponding focusing lens. Thus, it is possible to more effectively prevent occurrence of the crosstalk in the main scanning direction XX where the light beam emitted from the light-emitting device 2951 located at the end of the light-emitting device group 295 enters also the focus lens adjacent in the main scanning direction XX to the focus lens corresponding to the light-emitting device 2951, thus enabling more satisfactory spot to be formed.

The image forming apparatus according to the embodiment of the present invention uses the line head as described above to form a spot on the photosensitive drum surface (latent image carrier surface). That is, the image forming apparatus can form a latent image on the photosensitive drum surface while preventing occurrence of the crosstalk.

The present invention is not limited to the above embodiments and various changes and modifications can be made within the spirit and scope of the present invention. That is, the configuration of the light-emitting device group 295 is not limited to that as shown in FIG. 7, as long as the line head in which the main scanning direction width Gx is set larger than the sub-scanning group width Gy has a configuration in which the main scanning direction group pitch Px is set larger than the sub-scanning group pitch Py and is capable of preventing occurrence of the crosstalk in the main scanning direction as well as achieving satisfactory spot formation.

Although an organic EL is used as the light-emitting device 2951 in the above embodiment, an LED (Light Emitting Diode), etc. may be used as the light-emitting device 2951.

Although the color image forming apparatus has been described in connection with the above embodiment, the present invention is not limited to this, and may be also applied to a monochrome image that forms a monochrome image.

EXAMPLES

The present invention will next be described using examples; however, the present invention is not limited thereto.

Synthesis of Cross-Linked Polyester Resin

Raw materials such as acid, alcohol component, and catalyst having the following compositions were poured into a 50-liter reaction vessel and reacted in a nitrogen stream under ordinary pressure at 240° C. for 12 hours. Thereafter, the reaction was conducted at 10 mm Hg while the pressure was gradually reduced. The reaction was traced by the softening point according to ASTM E28-517, and the reaction was terminated when the softening point reached 160° C.

| | |
|---|---|
| Terephthalic acid | 3.9 parts by mass |
| Isophthalic acid | 9.06 parts by mass |
| Ethylene glycol | 2.54 parts by mass |
| Neopentyl glycol | 4.26 parts by mass |
| Tetrabutyl titanate | 0.1 parts by mass |
| Epichlon 830 | 0.3 parts by mass |

(bisphenol F epoxy resin manufactured by Dainippon Ink and Chemicals Inc.); epoxy equivalent=170 g/eq

| | |
|---|---|
| Cardura E | 0.1 parts by mass |

(alkyl glycidyl ester manufactured by Shell Chemicals Japan Ltd.); epoxy equivalent=250 g/eq The obtained cross-linked polyester resin was a colorless solid having an acid value of 11.0, glass transition temperature (Tg) of 60° C., and softening point (T1/2) of 178° C.

The weight-average molecular weight of the cross-linked polyester resin was measured by a GPC measurement apparatus (HLC-8120GPC manufactured by Tosoh Corporation). TSK-GEL G5000HXL/G4000HXL/G3000HXL/G2000HXL (manufactured by Tosoh Corporation) were used in combination as a separation column. The measure condition was as follows.

Column temperature: 40° C.

Solvent: Tetrahydrofuran

Solvent concentration: 0.5% by weight

Filter: 0.2 μm

Flow rate: 1 ml/min

The weight average molecular weight (converted to a standard polystyrene basis) of the obtained cross-linked polyester resin was 250,000.

Synthesis of Straight-Chain Polyester Resin

Raw materials such as acid, alcohol component, and catalyst having the following compositions were poured into a 50-liter reaction vessel and reacted in a nitrogen stream under ordinary pressure at 210° C. for 12 hours. Thereafter, the reaction was conducted at 10 mm Hg while the pressure was gradually reduced. The reaction was traced by the softening point according to ASTM E28-517, and the reaction was terminated when the softening point reached 87° C.

| | |
|---|---|
| Terephthalic acid | 5.31 parts by mass |
| Isophthalic acid | 7.97 parts by mass |
| Ethylene glycol | 2.6 parts by mass |
| Neopentyl glycol | 4.37 parts by mass |
| Tetrabutyl titanate | 0.1 parts by mass |

The obtained straight-chain polyester resin was a colorless solid having an acid value of 10.0, glass transition temperature (Tg) of 46° C., and softening point (T1/2) of 95° C.

The weight average molecular weight of the obtained straight-chain polyester resin measured in the same manner as the case of the cross-linked polyester resin was 5,200.

Production of Resin Mother Particle 1

Preparation of Wax Master Dispersion Liquid

After preliminary mixture of 30 parts by mass of Carnauba wax (Carnauba wax #1 manufactured by S Kato & Co.), 70 parts by mass of previously produced straight-chain polyester resin, and 150 parts by mass of methyl ethyl ketone by using DESPER, Star Mill LMZ-10 (made by Ashizawa Finetech Ltd.) was used to atomize the mixture, whereby 40 parts by mass (in solid content equivalency) of wax master dispersion liquid was prepared. The dispersion liquid had a composition of straight-chain polyester resin/wax/methyl ethyl ketone=28/12/60.

Preparation of Colorant Master Chip

Two thousands parts by mass of cyan pigment particles (Ket Blue 104 manufactured by Dainippon Ink and Chemicals Inc.) and 2000 parts by mass of straight-chain polyester resin were poured into 20-liter Henschel mixer (manufactured by Mitsui Mining Co., Ltd.) provided with ST/AO stirring blade and stirred for two minutes at a stirring speed of 698 $min^{-1}$, whereby a mixture was obtained. The obtained mixture was then fused and kneaded using an open roll-type continuous kneader "Kneadex MOS140-800" (manufactured by Mitsui Mining Co., Ltd.), whereby a colorant master chip was prepared.

The obtained master chip was diluted by the straight-chain polyester resin and methyl ethyl ketone, and the finely dispersed state of the colorant and presence/absence of coarse particles were observed using a 400-power optical microscope. The coarse particles did not exist and colorant was finely dispersed in a homogeneous manner. The master chip had a composition of colorant/straight-chain polyester resin=50/50 by mass ratio.

Preparation of Colorant Resin Solution 10.8 parts by mass of wax master dispersion liquid, 10.4 parts by mass of colorant master chip, 12 parts by mass of cross-linked polyester resin, 10 parts by mass of straight-chin polyester resin, and 8.65 parts by mass of methyl ethyl ketone were mixed using a stirring machine (DESPER (blade diameter: 230 mm) manufactured by Asada Tekko Co., Ltd.) for two hours at a stirring speed of 777 $min^{-1}$ at 40 to 45° C.

Methyl ethyl ketone was added to the obtained mixture, whereby the solid content was adjusted to 65% by mass. Then, 0.22 parts by mass of dodecylbenzenesulfonic acid emulsifying agent (manufactured by Daiichi Kogyo Seiyaku Co., Ltd.) was added, whereby a colorant resin solution containing the cyan pigment particles was prepared.

Transfer and Emulsification Step 46.37 parts by mass (solid content: 30 parts by mass) of the colorant resin solution was poured into a cylindrical vessel provided with a stirring machine (DESPER manufactured by Asada Tekko Co., Ltd.) having a stirring blade with a blade diameter of 230 mm and, then, 5 parts by mass of 1-normal ammonia water was added as a base compound to the colorant resin solution. Then, the resultant solution was sufficiently stirred at a stirring speed of 777 $min^{-1}$, followed by temperature adjustment to 35° C.

Subsequently, the stirring speed was changed to 1100 $min^{-1}$, and 37.25 parts by mass of water was dropped at a speed of 1.0 part by mass/min. The peripheral speed of the stirring blade at this time was 13.2 m/s. Although the viscosity of the system was increased as the water was added, the water was introduced into the system upon dropping, and thus stirring and mixing was carried out in a homogeneous manner.

At the stage at which 26 parts by mass of water was added, a phase inversion point at which the viscosity is rapidly decreased was observed. Further, slurry was observed using an optical microscope after the addition of the water. Although dissolved state of the resin and dispersed state of the colorant dispersoid and wax dispersoid were observed, unemulsified component was not observed. It is considered that the resin was adhered to the surface of the dispersoid since the colorant dispersoid and wax dispersoid were stably dispersed in the aqueous medium. At this time, a homogeneous state was maintained in the system, and occurrence of coarse particles was not observed.

Coalescence Step

Emulsified suspension obtained in the transfer and emulsification step was transferred to a cylindrical vessel provided with a Max Blend Blade™ having a blade diameter of 340 mm. Then, the temperature was adjusted to 25° C. while the stirring speed was maintained at 85 $min^{-1}$. Thereafter, the stirring speed was increased to 120 $min^{-1}$, and 12 parts by mass of 3.5% a by mass sodium sulfate aqueous solution was dropped as a first-stage electrolyte aqueous solution at a speed of 1 kg/min. After 5 minutes had elapsed from the completion of the dropping, the stirring speed was decreased to 85 $min^{-1}$, followed by stirring for 5 minutes. Thereafter, the stirring speed was decreased to 65 $min^{-1}$, followed by stirring for 5 minutes. Subsequently, the stirring speed was decreased to 47 $min^{-1}$, and the stirring was continued for 30 minutes, whereby resin mother particles 1 having a Dv of 2.9 μm and Dv/Dn of 1.09 were produced.

Production of Resin Mother Particles 2

Resin mother particles 2 having a Dv of 3.1 μm and Dv/Dn of 1.15 were produced under the same production condition as the resin mother particles 1 except that 12 parts by mass of 3.5% by mass sodium sulfate aqueous solution was dropped at a speed of 3 kg/min in the coalescence step of producing the resin mother particle 1.

Production of Resin Mother Particles 3

Resin mother particles 3 having a Dv of 3.2 μm and Dv/Dn of 1.25 were produced under the same production condition as the resin mother particles 1 except that 12 parts by mass of 3.5% by mass sodium sulfate aqueous solution was dropped at a speed of 6 kg/min in the coalescence step of producing the resin mother particle 1.

Production of Resin Mother Particles 4

Resin mother particles 4 having a Dv of 1.9 μm and Dv/Dn of 1.09 were produced under the same production condition as the resin mother particles 1 except that the time length of the last stirring (stirring speed: 47 $min^{-1}$) was reduced to 10 minutes.

Production of Resin Mother Particles 5

After the coalescence step of producing the resin mother particle 1, the following second-stage coalescence step was carried out. The stirring speed was adjusted to 120 $min^{-1}$, and 2 parts by mass of 5% by mass sodium sulfate aqueous solution was dropped as a second-stage electrolyte aqueous solution at a speed of 1 kg/min. After 5 minutes had elapsed from the completion of the dropping, the stirring speed was decreased to 85 $min^{-1}$, followed by stirring for 5 minutes. Thereafter, the stirring speed was decreased to 65 $min^{-1}$, followed by stirring for 5 minutes. Subsequently, the stirring speed was decreased to 47 $min^{-1}$, and the stirring was continued for 20 minutes, whereby resin mother particles 5 having a Dv of 4.1 μm and Dv/Dn of 1.09 were produced.

Production of Resin Mother Particles 6

Resin mother particles 6 having a Dv of 7 μm and Dv/Dn of 1.09 were produced under the same production condition as the resin mother particles 1 except that the time length of the last stirring (stirring speed: 47 $min^{-1}$) was increased to 60 minutes.

Examples 1 to 5 and Comparative Examples 1 to 10

Two grams of silica fine particles (RX 200) produced by Nippon Aerosil Co., Ltd., and 1.5 g of silica fine particles (RX 50) produced by Nippon Aerosil Co., Ltd. are added respectively to 100 g of resin mother particles 1 to 6. The resultant mixture was stirred in a 1-liter juicer at a stirring speed of 1000 $min^{-1}$ for 3 minutes. Subsequently, perfluoro polyether (BARRIERTA J25V produced by NOK Corporation) which is fluorine oil was added in an amount shown in Table 1 to the juicer. Then, the resultant mixture was stirred at a stirring speed of 10000 $min^{-1}$ for 3 minutes, whereby the toner was produced. The resin mother particles 1 were used in Examples 1 to 5 and Comparative examples 1 to 3, resin mother particles 2 were used in Comparative example 4, resin mother particles 3 were used in Comparative example 5, resin mother particles 4 were used in Comparative example 6, resin mother particles 5 were used in Comparative examples 7 and 8, and resin mother particles 6 were used in Comparative examples 9 and 10.

Meanwhile, the image forming apparatus of FIG. 1 including: a development unit in which a 50 μm development gap was formed between a photoreceptor having a diameter of 40 mm and development roller with an acetate tape having a thickness of 50 μm wound around both ends of a development roller having a diameter of 18 mm as a spacer; and the above-mentioned line head was produced.

One hundred grams of the produced toner was loaded in a development cartridge of the image forming apparatus, and printing tests were conducted. Results of the printing tests are shown in Table 1. Printing test conditions were the same as those of the printing condition of LP9000C manufactured by Seiko Epson Corporation except for the following conditions.

Toner feed amount: (toner diameter μm)×0.08 $mg/cm^2$

Development condition: alternating bias of Vdc=300V, Vpp=1000V, and frequency=6000 Hz Exposure power: 0.5 $\mu J/cm^2$ Average exposure spot diameter: 30 μm for 1/e2 diameter Particle Diameter of Resin Mother Particles The diameter of the resin mother particles was measured using PFIA-2000 manufactured by Hosokawa Micron Corporation.

Toner Bulk Density

The bulk density of the toner was measured according to JIS Z 7302-9.

Development Efficiency

Adhesive tapes were adhered to the photoreceptor and development roller, respectively, and the amount of the toner adhered to the adhesive tapes was measured, whereby development efficiency=(toner amount on photoreceptor)/(toner amount on development roller) was calculated.

Development Unevenness

Half-tone printing was performed for A3 size sheet at an image density of 30%, 20 random OD values were measured, and the maximum difference between OD values was determined as the development unevenness gates in which resin mother particles having a structure wherein small-diameter resin mother particles are entrapped between the large-diameter resin mother particles are strongly aggregated. In the case where the toner of Comparative examples 4 and 5 were used to carry out the printing test, the development efficiency was low and development unevenness was large.

TABLE 1

| | Resin mother particle volume average diameter (μm) | Dv/Dn | Fluorine oil additive amount (parts by weight/resin mother particles 100 g) | Bulk Density (g/cm$^3$) | Development Efficiency (%) | Development unevenness |
|---|---|---|---|---|---|---|
| Example 1 | 2.9 | 1.09 | 0.05 | 0.25 | 78 | 0.1 or less |
| Example 2 | 2.9 | 1.09 | 0.1 | 0.27 | 79 | 0.1 or less |
| Example 3 | 2.9 | 1.09 | 0.5 | 0.28 | 80 | 0.1 or less |
| Example 4 | 2.9 | 1.09 | 1 | 0.30 | 80 | 0.1 or less |
| Example 5 | 2.9 | 1.09 | 1.9 | 0.33 | 65 | 0.1 or less |
| Comparative Example 1 | 2.9 | 1.09 | 0 | 0.22 | 83 | 0.3 |
| Comparative Example 2 | 2.9 | 1.09 | 2.5 | 0.36 | 36 | 0.5 |
| Comparative Example 3 | 2.9 | 1.09 | 3 | 0.37 | 32 | 0.8 |
| Comparative Example 4 | 3.1 | 1.15 | 0.5 | 0.32 | 55 | 0.3 |
| Comparative Example 5 | 3.2 | 1.25 | 0.5 | 0.36 | 44 | 0.5 |
| Comparative Example 6 | 1.9 | 1.09 | 0.5 | 0.24 | 55 | 0.5 |
| Comparative Example 7 | 4.1 | 1.09 | 0.5 | 0.38 | 83 | 0.1 or less |
| Comparative Example 8 | 4.1 | 1.09 | 0 | 0.30 | 87 | 0.1 or less |
| Comparative Example 9 | 7.0 | 1.09 | 0.5 | 0.42 | 82 | 0.1 or less |
| Comparative Example 10 | 7.0 | 1.09 | 0 | 0.34 | 87 | 0.1 or less |

The toner of Examples 1 to 5 had humidity, and scattering of the resin mother particles from the toner was unlikely to occur. The development efficiency of printing operation in this image forming apparatus using the toner was as high as 65% or more, and development unevenness was 0.1 or less; uniform development was thus achieved.

In the case where the toner of Example 3 and a development unit using a direct current bias were used to carry out the printing test, the development efficiency was as low as 20% and development unevenness was 0.3; uniform development was thus not achieved. It was confirmed that the development unit that did not use an alternating current bias did not crack the secondary particles in which the resin mother particles are aggregated.

The toner of Comparative example 1 to which the fluorine oil had not been added was likely to scatter. In the case where the toner of Comparative example 1 was used to carry out the printing test, the development efficiency was as high as 83% but development unevenness was 0.3; uniform development was thus not achieved.

The toner of Comparative examples 2 and 3 to which excessive amount of the fluorine oil had been added contained large-sized aggregates in which the resin mother particles are strongly aggregated. In the case where the toners of Comparative examples 2 and 3 were used to carry out the printing test, the development efficiency was low and development unevenness was large.

It can be considered that the toner of Comparative examples 4 and 5 produced using resin mother particles whose particle size distribution is too large contains aggre- In the case where the toner of Comparative example 6 produced using resin mother particles having an excessively small volume-average particle diameter was used to carry out the printing test, the development efficiency was low and development unevenness was large.

In the case where the toner of Comparative examples 7 to 10 produced using resin mother particles having an excessively large volume-average particle diameter were used to carry out the printing test, the development efficiency was high and development unevenness was 0.1 or less; uniform development was thus achieved. It was confirmed that the toner containing resin mother particles whose volume-average particle diameter is 4 μm or more enabled stable development irrespective of presence/absence of the fluorine oil. The resolution of an image obtained using the toner containing resin mother particles whose volume-average particle diameter is 4 μm or more is lower than that obtained using the toner containing resin mother particles whose volume-average particle diameter is 4 μm or less.

Examples 6 to 12 and Comparative Examples 11 to 17

Two grams of silica fine particles (RX 200) produced by Nippon Aerosil Co., Ltd., and 1.5 g of silica fine particles (RX 50) produced by Nippon Aerosil Co., Ltd. are added respectively to 100 g of resin mother particles 1 to 6. The resultant mixture was stirred in a 1-liter juicer at a stirring speed of 1000 min$^{-1}$ for 3 minutes. Subsequently, dimethyl silicone oil (KF-96-200CS manufactured by Shinetsu Chemical Industry Co., Ltd.) having a kinetic viscosity of 200 $mm^2/s$ (at 25° C.) and dimethyl silicone oil (KF-96-20CS manufactured by Shinetsu Chemical Industry Co., Ltd.) having a kinetic viscosity of 20 $mm^2/s$ (at 25° C.) or dimethyl silicone oil (KF-96-350CS manufactured by Shinetsu Chemical Industry Co., Ltd.) having a kinetic viscosity of 350 $mm^2/s$ (at 25° C.) were added in an amount shown in Table 2 to the juicer. Then, the resultant mixture was stirred at a stirring speed of 10000 $min^{-1}$ for 3 minutes, whereby the toner was produced. One hundred grams of the produced toner was loaded in a development cartridge of the image forming apparatus, and printing tests were conducted. Results of the printing tests are shown in Table 2. The resin mother particles 1 were used in Examples 6 to 12 and Comparative examples 11 and 12, resin mother particles 2 were used in Comparative example 13, resin mother particles 3 were used in Comparative example 14, resin mother particles 4 were used in Comparative example 15, resin mother particles 5 were used in Comparative example 16, and resin mother particles 6 were used in Comparative example 17.

TABLE 2

| | Resin mother particle volume average diameter (μm) | Dv/Dn | Silicone oil additive amount (parts by weight/ Resin mother particles 100 g) | Silicone oil Kinetic viscosity ($mm^2/s$) | Bulk Density ($g/cm^3$) | Development Efficiency (%) | Development unevenness |
|---|---|---|---|---|---|---|---|
| Example 6 | 2.9 | 1.09 | 0.05 | 200 | 0.25 | 77 | 0.1 or less |
| Example 7 | 2.9 | 1.09 | 0.1 | 200 | 0.27 | 78 | 0.1 or less |
| Example 8 | 2.9 | 1.09 | 0.5 | 200 | 0.28 | 81 | 0.1 or less |
| Example 9 | 2.9 | 1.09 | 1 | 200 | 0.30 | 81 | 0.1 or less |
| Example 10 | 2.9 | 1.09 | 1.9 | 200 | 0.34 | 64 | 0.1 or less |
| Comparative Example 11 | 2.9 | 1.09 | 2.5 | 200 | 0.36 | 35 | 0.5 |
| Comparative Example 12 | 2.9 | 1.09 | 3 | 200 | 0.37 | 32 | 0.8 |
| Comparative Example 13 | 3.1 | 1.15 | 0.5 | 200 | 0.32 | 54 | 0.3 |
| Comparative Example 14 | 3.2 | 1.25 | 0.5 | 200 | 0.36 | 43 | 0.5 |
| Comparative Example 15 | 1.9 | 1.09 | 0.5 | 200 | 0.24 | 54 | 0.5 |
| Comparative Example 16 | 4.1 | 1.09 | 0.5 | 200 | 0.37 | 82 | 0.1 or less |
| Comparative Example 17 | 7.0 | 1.09 | 0.5 | 200 | 0.42 | 82 | 0.1 or less |
| Example 11 | 2.9 | 1.09 | 0.5 | 20 | 0.20 | 73 | 0.3 |
| Example 12 | 2.9 | 1.09 | 0.5 | 350 | 0.33 | 62 | 0.6 |

The toner of Examples 6 to 10 had humidity, and scattering of the resin mother particles from the toner was unlikely to occur. The development efficiency of printing operation in this image forming apparatus using the toner was as high as 64% or more, and development unevenness was 0.1 or less; uniform development was thus achieved.

In the case where the toner of Example 8 and a development unit using a direct current bias were used to carry out the printing test, the development efficiency was as low as 18% and development unevenness was 0.3; uniform development was thus not achieved. It was confirmed that the development unit that did not use an alternating current bias did not crack the secondary particles in which the resin mother particles are aggregated.

In the case where the toner of Example 11 produced using the dimethyl silicone oil having a kinetic viscosity of less than 50 $mm^2/s$ (at 25° C.) and the toner of Example 12 produced using the dimethyl silicone oil having a kinetic viscosity exceeding 300 $mm^2/s$ (at 25° C.) were used to carry out the printing test, the development efficiency was as high as 62% but development unevenness was as large as 0.3.

The toner of Comparative examples 11 and 12 to which excessive amount of the silicone oil had been added contained large-sized aggregates in which the resin mother particles are strongly aggregated. In the case where the toner of Comparative examples 11 and 12 were used to carry out the printing test, the development efficiency was low and development unevenness was large.

It can be considered that the toner of Comparative examples 13 and 14 produced using resin mother particles whose particle size distribution is too large contains aggregates in which resin mother particles having a structure wherein small-diameter resin mother particles are entrapped between the large-diameter resin mother particles are strongly aggregated. In the case where the toner of Comparative examples 13 and 14 were used to carry out the printing test, the development efficiency was low and development unevenness was large.

In the case where the toner of Comparative example 15 produced using resin mother particles having an excessively small volume-average particle diameter was used to carry out the printing test, the development efficiency was low and development unevenness was large.

In the case where the toner of Comparative examples 16 and 17 produced using resin mother particles having an excessively large volume-average particle diameter were used to carry out the printing test, the development efficiency was high and development unevenness was 0.1 or less; uniform development was thus achieved. It was confirmed that the toner containing resin mother particles whose volume-average particle diameter is 4 μm or more enabled stable development irrespective of presence/absence of the silicone oil.

What is claimed is:

1. A toner containing resin mother particles and oil, wherein the volume-average particle diameter of the resin mother particles is not less than 2 μm but less than 4 μm, (volume-average particle diameter of the resin mother particles)/(number-average particle diameter of the resin mother particles) is more than 1 but less than 1.1, the oil is silicone oil or fluorine oil, and the content of the silicone oil or fluorine oil is not less than 0.05% by mass but less than 2% by mass relative to the resin mother particles.

2. The toner according to claim 1, wherein the bulk density of the resin mother particles is not less than 0.25 g/cm$^3$ but less than 0.35/cm$^3$.

3. The toner according to claim 1, wherein the oil is dimethyl silicone oil having a kinetic viscosity of 50 to 300 mm$^2$/s at 25° C.

4. The toner according to claim 1, wherein a binder resin of the resin mother particles is a polyester resin.

5. The toner according to claim 4, wherein an acid value of the polyester resin is 3 to 30 KOHmg/g.

6. The toner according to claim 1, wherein the binder resin of the resin mother particles is a mixture of the cross-linked polyester resin and straight-chain polyester resin, the mixing ratio thereof being 5/95 to 60/40.

7. The toner according to claim 6, wherein the cross-linked polyester resin has a glass transition temperature of 40 to 85° C. and a softening point of 150 to 220° C.

8. The toner according to claim 6, wherein the straight-chain polyester resin has a glass transition temperature of 35 to 70° C. and a softening point of 90 to 130° C.

9. The toner according to claim 1, wherein silica fine particles or titania fine particles are externally added.

10. A development unit which performs non-contact jumping development using a toner, the toner containing resin mother particles and oil, wherein the volume-average particle diameter of the resin mother particles is not less than 2 μm but less than 4 μm, (volume-average particle diameter of the resin mother particles)/(number-average particle diameter of the resin mother particles) is more than 1 but less than 1.1, the oil is silicone oil or fluorine oil, and the content of the silicone oil or fluorine oil is not less than 0.05% by mass but less than 2% by mass relative to the resin mother particles, the development unit comprising:

a photoreceptor;

a development roller; and a gap adjustment member provided on both sides of the development roller, the development roller being provided such that the toner feeding surface thereof is opposed to the photoreceptor with a predetermined development gap and feeding the toner to the photoreceptor, the gap adjustment member being a spacer which is brought into contact with the photoreceptor to set a development gap, and the spacer being made of a material having hygroscopicity higher than that of the development roller and fixed to the development roller through a layer having elasticity.

11. An image forming apparatus wherein a toner is used to perform an image formation process, the toner containing resin mother particles and oil, wherein the volume-average particle diameter of the resin mother particles is not less than 2 μm but less than 4 μm, (volume-average particle diameter of the resin mother particles)/(number-average particle diameter of the resin mother particles) is more than 1 but less than 1.1, the oil is silicone oil or fluorine oil, and the content of the silicone oil or fluorine oil is not less than 0.05% by mass but less than 2% by mass relative to the resin mother particles, the image forming apparatus comprising a development unit which performs non-contact jumping development using the toner and a line head, the development unit comprising:

a photoreceptor;

a development roller; and a gap adjustment member provided on both sides of the development roller, the development roller being provided such that the toner feeding surface thereof is opposed to the photoreceptor with a predetermined development gap and feeding the toner to the photoreceptor, the gap adjustment member being a spacer which is brought into contact with the photoreceptor to set a development gap, and the spacer being made of a material having hygroscopicity higher than that of the development roller and fixed to the development roller through a layer having elasticity, the line head focusing a light beam onto a surface to be scanned fed in the sub-scanning direction substantially perpendicular to the main scanning direction to form a spot and comprising: a plurality of light-emitting device groups each having a plurality of light-emitting devices; and a plurality of focusing lenses disposed in one-to-one correspondence with the light-emitting device groups and each focus a light beam emitted from each of the light-emitting devices belonging to the corresponding light emitting device group, wherein, in each light emitting device group, the light-emitting devices are two-dimensionally arranged such that a plurality of light-emitting device group lines comprising two or more light-emitting devices arranged in the main scanning direction are arranged in the sub-scanning direction in such a manner that a distance Gx between the upstreammost light-emitting device and downstreammost light-emitting device in the main scanning direction becomes larger than a distance Gy between the upstreammost light-emitting device and downstreammost light-emitting device in the sub-scanning direction, and the light-emitting device groups are two-dimensionally arranged such that a plurality of light-emitting device group lines comprising two or more light-emitting device groups arranged in the main scanning direction at a main scanning group pitch Px are arranged in the sub-scanning direction at a sub-scanning group pitch Py in such a manner that the main scanning group pitch Px becomes larger than sub-scanning group pitch Py.

* * * * *